US007331917B2

(12) United States Patent
Totani

(10) Patent No.: US 7,331,917 B2
(45) Date of Patent: Feb. 19, 2008

(54) BAG MAKING MACHINE

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 91 days.

(21) Appl. No.: 10/521,924

(22) PCT Filed: Jul. 22, 2003

(86) PCT No.: PCT/JP03/09287

§ 371 (c)(1),
(2), (4) Date: Jan. 21, 2005

(87) PCT Pub. No.: WO2004/009341

PCT Pub. Date: Jan. 29, 2004

(65) Prior Publication Data

US 2005/0272583 A1 Dec. 8, 2005

(30) Foreign Application Priority Data

Jul. 24, 2002 (JP) ..... 2002-215559
Dec. 25, 2002 (JP) ..... 2002-373948

(51) Int. Cl.
*B31B 1/26* (2006.01)

(52) U.S. Cl. ..... 493/244; 493/218; 493/918; 493/379

(58) Field of Classification Search ..... 493/218, 493/219, 918, 936, 379–381, 231, 391, 356, 493/360, 243–245
See application file for complete search history.

(56) References Cited

U.S. PATENT DOCUMENTS

| | | | | |
|---|---|---|---|---|
| 2,401,109 | A * | 5/1946 | Rohdin | 493/195 |
| 3,599,539 | A * | 8/1971 | Coverstone et al. | 493/189 |
| 4,055,109 | A * | 10/1977 | Kan | 493/196 |
| 5,937,617 | A * | 8/1999 | Yeager | 53/412 |
| 5,938,337 | A * | 8/1999 | Provan et al. | 383/5 |
| 6,186,932 | B1 * | 2/2001 | Vallot | 493/189 |
| 6,425,847 | B1 * | 7/2002 | Broenstrup | 493/231 |
| 6,517,660 | B2 * | 2/2003 | Ausnit | 156/270 |
| 6,561,963 | B2 * | 5/2003 | Totani | 493/218 |

FOREIGN PATENT DOCUMENTS

| | | |
|---|---|---|
| JP | 1-202429 | 8/1989 |
| JP | 6-170986 | 6/1994 |
| JP | 10-166477 | 6/1998 |

* cited by examiner

*Primary Examiner*—Hemant M. Desai
(74) *Attorney, Agent, or Firm*—Hodgson Russ LLP

(57) ABSTRACT

Plastic bag making apparatus by which it is arranged that even if a bottom gusset member is not specially supplied, a bottom gusset can be incorporated into a plastic bag. As continuous trunk members (1,2) are fed, they are guided by a trunk guide mechanism (16-29) and folded along a longitudinal fold line (8). Then, the folded portion (4) is folded back along a longitudinal fold-back line (10), whereby a twofold section is formed of the trunk members, with the continuous trunk members forming the trunk of the plastic bag, the twofold section forming the bottom gusset of the plastic bag.

6 Claims, 16 Drawing Sheets

BAG MAKING MACHINE

This application is 371 of PCT/JP03/09287 filed on Jul. 22, 2003.

TECHNICAL FIELD

The invention relates to an apparatus for successively making plastic bags.

BACKGROUND

An apparatus has heretofore been developed and proposed to successively make plastic bags each of which includes a bottom gusset portion incorporated into superposed two layers of panel portion, as disclosed in Japanese Laid-Open Patent Publication No. 254,984 of 2,000. The plastic bag may include side gusset portions.

In the apparatus of the publication, webs of panel material are superposed into two layers and fed longitudinally thereof. In addition, sheets of side gusset material are folded into halves and supplied to and put on one of the layers of panel material one by one before the layers of panel material are superposed with each other, to extend widthwise of one of the layers of panel material. Furthermore, a web of bottom gusset material is supplied to and put on one of the layers of panel material and folded into halves. The web of bottom gusset material extends longitudinally of one of the layers of panel material to be disposed along one of the side edges thereof. The layers of panel material are then superposed with each other so that the sheets of side gusset material and the web of bottom gusset material can be interposed between the layers of panel material. The web of bottom gusset material may be supplied to the webs of panel material after the layers of panel material are superposed with each other. The layers of panel material are then heat sealed with the web of bottom gusset material by longitudinal seal means. In addition, the layers of panel material are heat sealed with the sheets of side gusset material by cross seal means. The webs of panel material are then cut widthwise thereof by a cutter at the position of the sheet of side gusset material. The apparatus can therefore successively make plastic bags each of which includes a bottom gusset portion formed by the web of bottom gusset material and incorporated into superposed two layers of panel portion which are formed by the webs of panel material. The plastic bag further includes side gusset portions formed by the sheets of side gusset material.

However, in this case, the apparatus involves not only side gusset material supply means by which the sheets of side gusset material are supplied but also bottom gusset material supply means by which the web of bottom gusset material is supplied. The apparatus must therefore be complicated in structure and high in cost. Furthermore, the apparatus is large sized by the bottom gusset material supply means. A large space is therefore required for installation.

It is therefore an object of the invention to provide a new and improved apparatus which can successively make plastic begs each of which includes a bottom gusset portion incorporated into superposed two layers of panel portion, without involving bottom gusset material supply means.

DISCLOSURE OF THE INVENTION

According to the invention, the apparatus includes panel material feeding means by which web means of panel material is fed longitudinally thereof. The apparatus further includes panel material guide means by which the web means of panel material is guided to be folded and folded back along a longitudinal folded line and a longitudinal folded back line when being fed so that a folded portion can be formed in the web means of panel material and folded into halves. The plastic bag includes the bottom gusset portion formed by the folded portion and incorporated into the layers of panel portion which are formed by the web means of panel material.

The apparatus may include side gusset material supply means by which sheets of side gusset material are supplied to the web means of panel material to extend widthwise thereof, the plastic bag including side gusset portions formed by the sheets of side gusset material.

It is preferable that the panel material guide means includes first guide means by which the web means of panel material is guided to be folded along the longitudinal folded line when being fed. The panel material guide means further includes second guide means by which the web means of panel material is guided to be folded back along the longitudinal folded back line when being fed and after being folded so that the folded portion can be formed in the web means of panel material and folded into halves.

In a preferred embodiment, the web means of panel material is fed longitudinally thereof and superposed into two layers each of which has opposite side edges. The apparatus further includes panel material guide means by which one of the layers of panel material is guided to be folded and folded back along a longitudinal folded line and a longitudinal folded back line near one of the side edges thereof when being fed so that a folded portion can be formed in one of the layers of panel material and folded into halves, the folded portion having a free side edge formed by one of the side edges. The folded portion is interposed between the layers of panel material. The apparatus further includes longitudinal seal means by which the free side edge is heat sealed with the corresponding side edge of the other layer of panel material before or after the folded portion is folded into halves.

In the embodiment, the sheets of side gusset material are supplied to the web means of panel material to extend widthwise thereof. The sheets of side gusset material are interposed between the layers of panel material. The apparatus further includes cross seal means by which the layers of panel material are heat sealed with the sheets of side gusset material.

In the embodiment, the panel material guide means includes first guide means by which one of the layers of panel material is guided to be folded along the longitudinal folded line when being fed. The panel material guide means further includes second guide means by which one of the layers of panel material is guided to be folded back along the longitudinal folded back line when being fed and after being folded so that the folded portion can be formed in one of the layers of panel material and folded into halves. The Folded portion is combined with the sheet of side gusset material by means of folded and folded back procedures in which one of the layers of panel material is folded and then folded back by the first and second guide means.

Furthermore, in the embodiment, one of the layers of panel material is superposed with the other layer of panel material before being folded, to have one of the side edges protruding beyond the corresponding side edge of the other layer of panel material at a distance. One of the layers of panel material is then folded by the first guide means at a width which corresponds to the distance between one of the side edges and the corresponding side edge while the other layer of panel material is folded by the first guide means at a width which is half as much as the distance so that one of the side edges can be coincided with the corresponding side edge. One of the layers of panel material is then folded back by the second guide means so that the folded portion can be formed in one of the layers of panel material and folded into halves while the other layer of panel material is unfolded for restoration so that the folded portion can be combined with the sheet of side gusset material and interposed between the layers of panel material.

In other embodiment, the apparatus includes panel material guide means by which one of the layers of panel material is guided to be folded and folded back along a longitudinal folded line and a longitudinal folded back line near one of the side edges thereof when being fed so that a first folded portion can be formed in one of the layers of panel material and folded into halves, the first folded portion having a first free side edge formed by one of the side edges. In addition, one of the layers of panel material is guided by the panel material guide means to be folded and folded back along a longitudinal folded line and a longitudinal folded back line near the other side edge thereof when being fed so that a second folded portion can be formed in one of the layers of panel material and folded into halves, the second folded portion having a second free side edge formed by the other side edge. The first and second folded portions are interposed between the layers of panel material. The apparatus further includes longitudinal seal means by which the first free side edge is heat sealed with the corresponding side edge of the other layer of panel material before or after the first folded portion is folded into halves. The second free side edge is heat sealed with the corresponding side edge of the other layer of panel material by the longitudinal seal means before or after the second folded portion is folded into halves. The plastic bag includes the bottom gusset portion formed by the first or second folded portion.

In other embodiment, the apparatus includes panel material guide means by which one of the layers of panel material is guided to be folded and folded back along a longitudinal folded line and a longitudinal folded back line near one of the side edges of the web means of panel material when being fed so that a first folded portion can be formed in one of the layers of panel material and folded into halves, the first folded portion having a first free side edge. The other layer of panel material is guided by the panel material guide means to be folded and folded back along a longitudinal folded line and a longitudinal folded back line near the other edge of the web means of panel material when being fed so that a second folded portion formed in the other layer of panel material and folded into halves, the second folded portion having a second free side edge. The apparatus further includes longitudinal seal means by which the first free side edge is heat sealed with the corresponding side edge of the other layer of panel material before or after the first folded portion is folded into halves. The second free side edge is heat sealed with the corresponding side edge of one of the layers of panel material by the longitudinal seal means before or after the second folded portion is folded into halves.

In other embodiment, first and second folded lines are assumed on the web means of panel material to extend longitudinally of the web means of panel material. An intermediate folded back line is assumed on the web means of panel material to extend longitudinally of the web means of panel material and between the first and second folded lines. The apparatus includes panel material guide means by which the web means of panel material is guided to be folded and folded back along the first and second folded lines and the intermediate folded back line when being fed so that a folded portion can be formed in the web means of panel material and between the first and second folded lines and folded into halves. The web means of panel material is superposed into two layers between which the folded portion is interposed.

In the embodiment, the panel material guide means includes first guide means by which the web means of panel material is guided to folded along the first folded line when being fed and after the sheet of side gusset material is supplied. The panel material guide means further includes second guide means by which the web means of panel material is guided to be folded back along the intermediate folded back line when being fed and after being folded. The panel material guide means further includes third guide means by which the web means of panel material is guided to be folded along the second folded line when being fed and after being folded back so that the folded portion can be formed in the web means of panel material and folded into halves. The folded portion is combined with the sheet of side gusset material by means of folded and folded back procedures in which the web means of panel material is folded, then folded back and folded again by the first, second and third guide means.

BEST MODE TO CARRY OUT THE INVENTION

Figure 1:
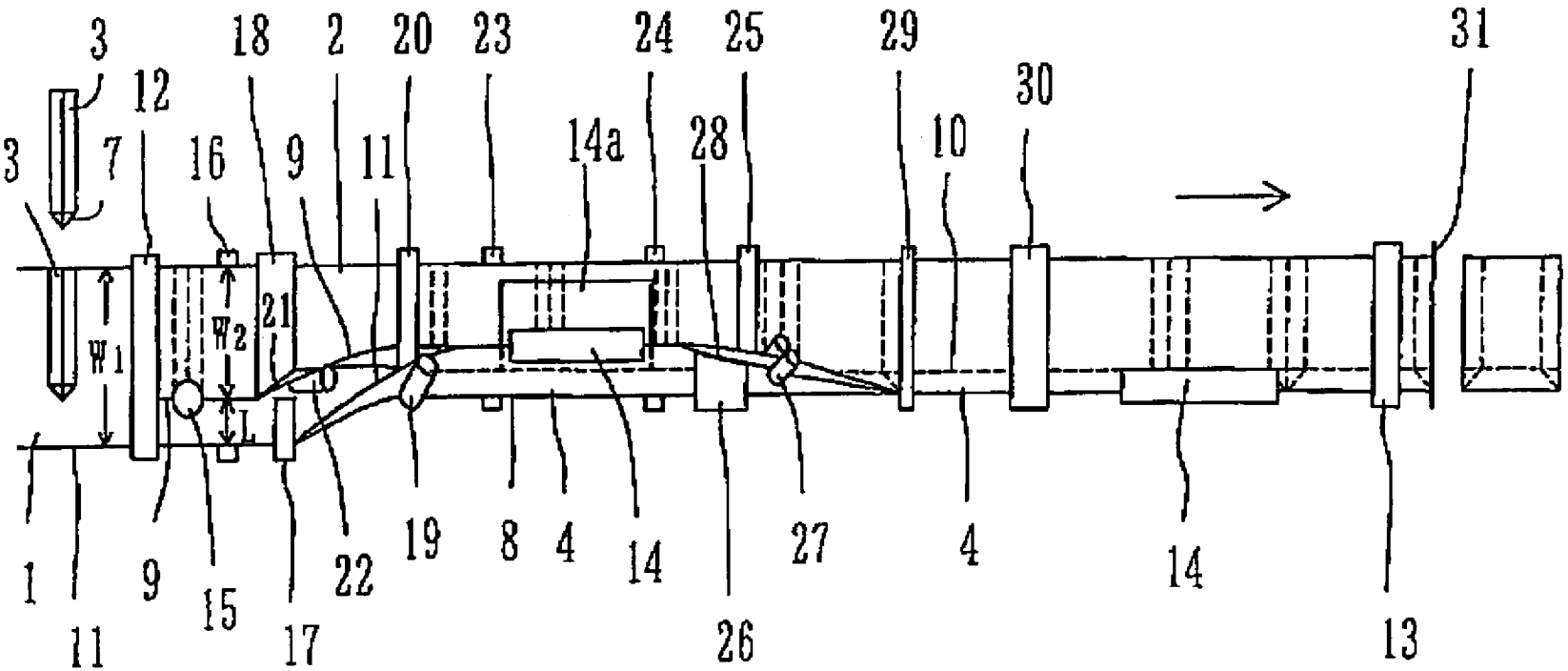
FIG. 1 is a plan view of a preferred embodiment of the invention.
Figure 7:
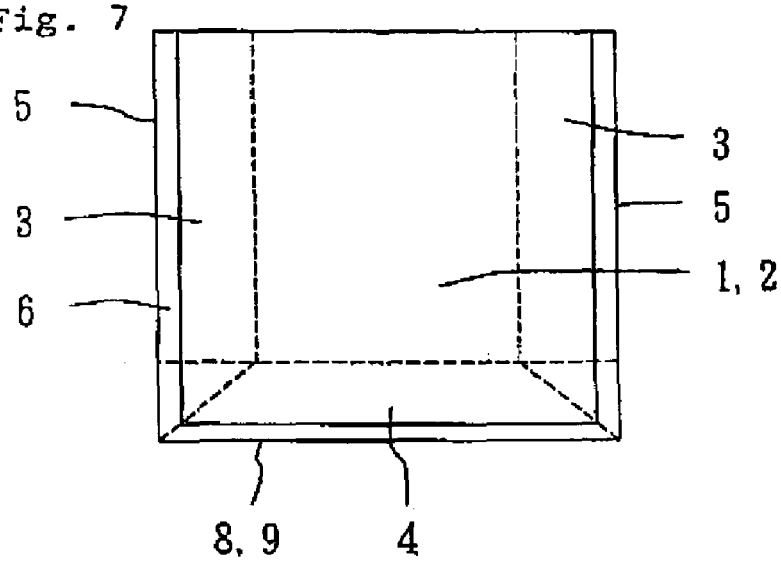
FIG. 7 is an explanatory view of a plastic bag obtained by the apparatus of FIG. 1.
Figure 8:
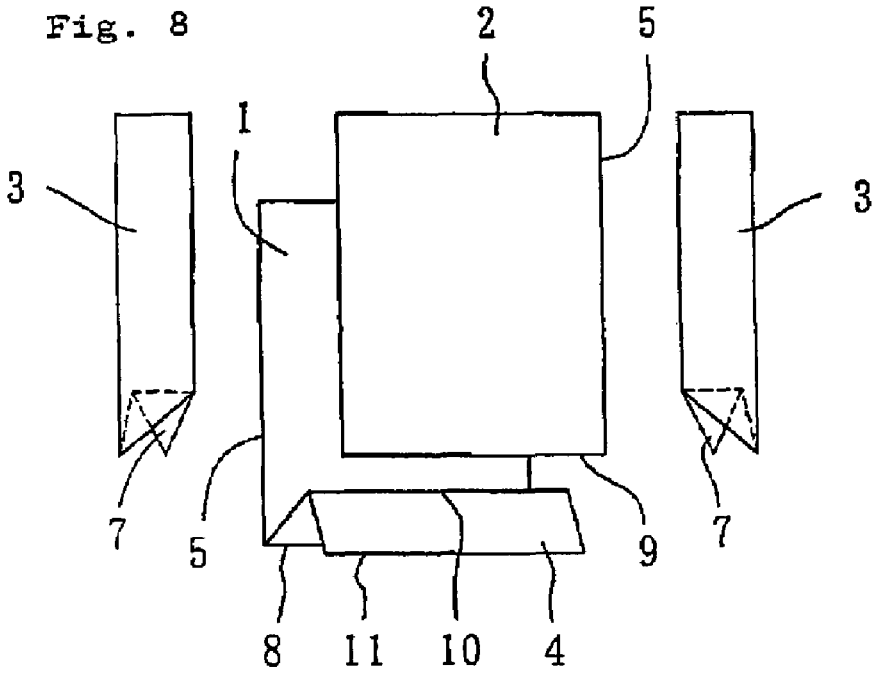
FIG. 8 is an explosive view of the plastic bag of FIG. 7.

Turning now to the drawings, FIG. 1 illustrates an apparatus for successively making plastic bags, according to the invention, each of which includes superposed two layers of panel portion 1 and 2, as shown in FIG. 7. The plastic bag further includes side gusset portions 3 and a bottom gusset portion 4 incorporated into the layers of panel portion 1 and 2, as in the case of plastic bag of Japanese Laid-Open Patent Publication No. 254,984 of 2000. Each of the layers of panel portion 1 and 2 has opposite side edges 5 along which the side gusset portions 3 extend. In addition, each of the side gusset portions 3 is folded into halves and interposed between the layers of panel portion 1 and 2, as shown in FIG. 8. The layers of panel portion 1 and 2 are heat sealed with the side gusset portions 3 along the side edges 5 of panel portion 1 and 2 so that heat sealed portions 6 can be formed along the side edges 5 of panel portion 1 and 2. Furthermore, each of the side gusset portions 3 has an end portion folded at an angle of 45°. The end portion is folded into halves and interposed between the layers of side gusset portion 3 so that an auxiliary gusset portion 7 can be formed by the end portion.

The layers of panel portion 1 and 2 further have bottom edges 8 and 9 along which the bottom gusset portion 4 extends. In addition, the bottom gusset portion 4 is folded into halves and interposed between the layers of panel portion 1 and 2, as also in the case of plastic bag of the publication. However, the bottom gusset portion 4 is formed by a folded portion formed in one of the layers of panel portion 1 folded and folded back. One of the layers of panel portion 1 therefore has a folded line 8 by which the bottom edge is formed. The bottom gusset portion 4 has a folded back line 10 formed therein. Furthermore, the auxiliary gusset portions 7 and the bottom gusset portion 4 are heat sealed with each other along the side edges 5 of panel portion 1 and 2 so that heat sealed portions 6 can be formed along the side edges 5 of panel portion 1 and 2. The bottom gusset portion 4 includes a free side edge 11 heat sealed with the bottom edge 9 of panel portion 2 so that a heat seal portion 6 can be heat sealed along the bottom edge 9 of panel portion 2. The plastic bag can therefore be enlarged by the side gusset portions 3 to obtain an increased capacity. A flat bottom surface can be formed by the bottom gusset portion 4 to make the plastic bag stand stably.

Figure 2:
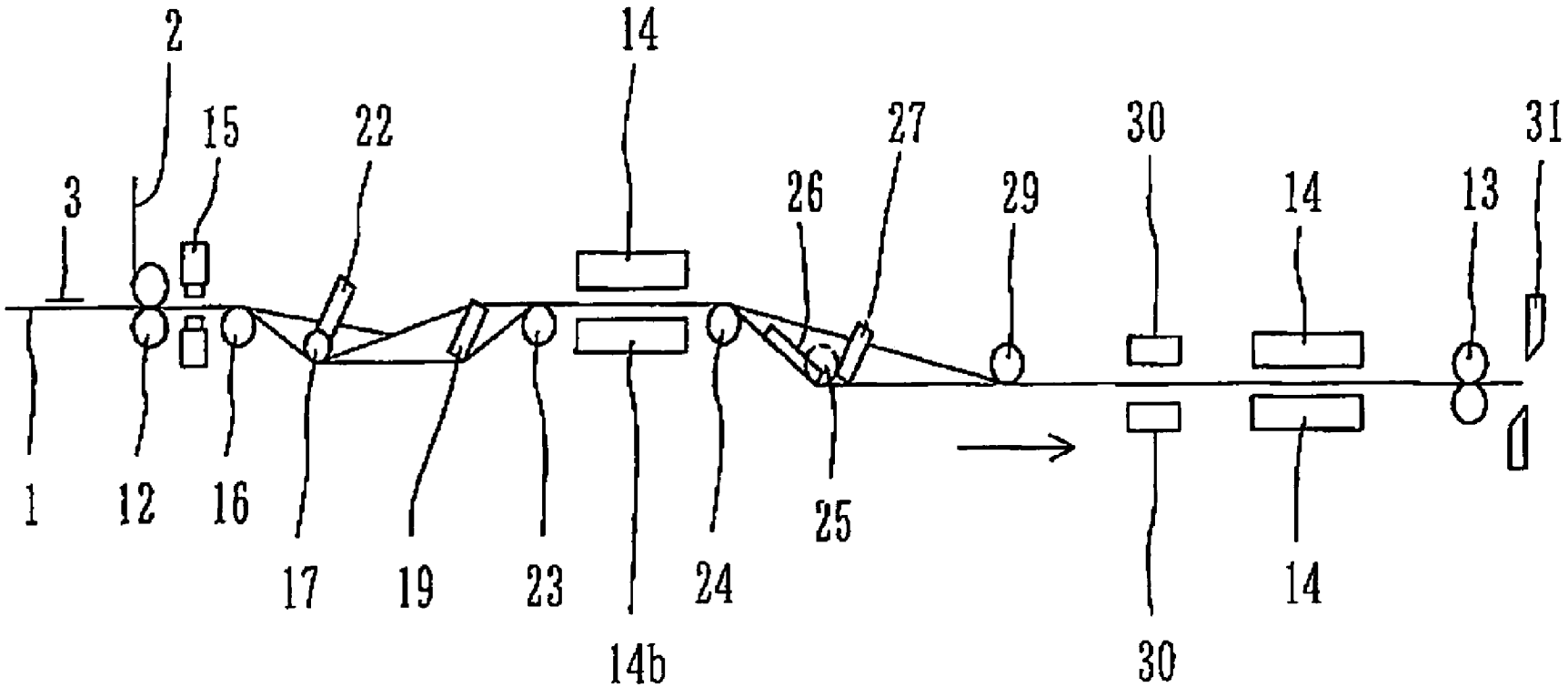
FIG. 2 is a side view of the apparatus of FIG. 1.

In order to successively make the plastic bags of FIG. 7, the apparatus includes panel material feeding means by which web means of panel material is fed longitudinally thereof. The web means of panel material comprises webs of panel material 1 and 2 superposed into two layers. The layers of panel material 1 and 2 comprise plastic films by which the layers of panel portion 1 and 2 of FIG. 8 are formed. The panel material feeding means comprises feeding rollers 12 and 13, one of the layers of panel material 1 being supplied horizontally and directed to and between the feeding rollers 12, as shown in FIG. 2. The other layer of panel material 2 is supplied downward and directed to and between the feeding rollers 12 so that the layers of panel material 1 and 2 can be superposed with each other. One of the layers of panel material 1 is therefore the lower one, the other layer of panel material 2 being the upper one. The layers of panel material 1 and 2 are then directed to and between the feeding rollers 13, the feeding rollers 12 and 13 being rotated by drive motors so that the webs of panel material 1 and 2 can be fed longitudinally thereof. The feeding rollers 12 and 13 are rotated intermittently so that the webs of panel material 1 and 2 can be fed intermittently.

Figure 3:
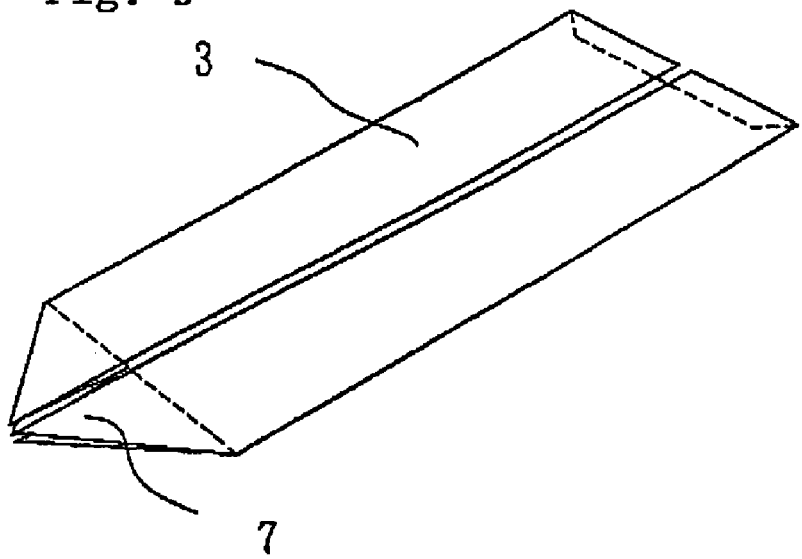
FIG. 3 is a perspective view of the sheet of side gusset material of FIG. 1.

The apparatus further includes side gusset material supply means by which sheets of side gusset material 3 are supplied to the web means of panel material one by one, to extend widthwise thereof. In the embodiment, each of the sheets of side gusset material 3 is previously folded into halves. The sheet of side gusset material 3 is then supplied to and put on the lower layer of panel material 1 to extend widthwise thereof, whenever the webs of panel material 1 and 2 are fed intermittently and before the layers of panel material 1 and 2 are superposed with each other. The sheets of side gusset material 3 comprise plastic films by which the side gusset portions 3 of FIG. 8 are formed. In the embodiment, the sheet of side gusset material 3 has a double width, which is previously folded into halves on the opposite sides of the longitudinal centerline to be superposed into two layers, as shown in FIG. 3. Furthermore, the sheet of side gusset material 3 includes an end portion folded at an angle of 45°. The end portion is folded into halves and interposed between the layers of side gusset material 3 so that the auxiliary gusset portion 7 of FIG. 8 can be formed by the end portion. The sheet of side gusset material 3 is then supplied to and put on the lower layer of panel material 1 to extend width pulse thereof, whenever the webs of panel material 1 and 2 are fed intermittently. It should be noted that the side gusset material supply means has the same structure as that of Japanese Laid-Open Patent Publication No. 254,984 of 2,000. No reference is therefore made to the structure herein.

The apparatus further includes panel material guide means by which one of the layers of panel material 1 is guided to be folded and folded back along a longitudinal folded line 8 and a longitudinal folded back line 10 near one of the side edges 11 thereof when being fed so that a folded portion 4 can be formed in one of the layers of panel material 1 and folded into halves. The folded portion 4 is then interposed between the layers of panel material 1 and 2, as described later in detail. In this connection, it should be noted that the bottom gusset portion 4 of FIG. 8 is formed by the folded portion 4, the folded line 8 of FIG. 8 being formed by the longitudinal folded line 8, the folded back line 10 of FIG. 8 being formed by the longitudinal folded back line 10. The folded portion 4 includes a free side edge 11 formed by one of the side edges 11 of one of the layers of panel material 1. It should also be noted that the free side edge 11 of FIG. 8 is formed by the free side edge 11 of folded portion 4. The bottom edge 9 of FIG. 8 is formed by the corresponding side edge 9 of the other layer of panel material 2. The longitudinal folded line 8 means that it extends longitudinally of the web of panel material 1. The longitudinal folded back line 10 also means that it extends longitudinally of the web of panel material 1. The apparatus further includes longitudinal seal means 14 by which the free side edge 11 is heat sealed with the corresponding side edge 9 of the other layer of panel material 2 before or after the folded portion 4 is folded into halves, as also described later in detail.

Figure 4:
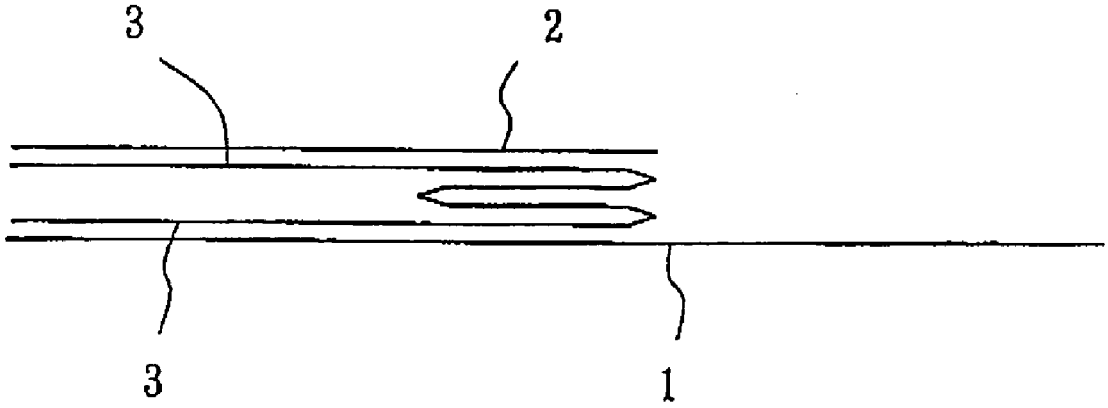
FIG. 4 is a sectional view of the webs of panel material and the sheet of side gusset material of FIG. 1.

Furthermore, in the embodiment, one of the layers of panel material 1 is directed to the feeding rollers 12 to be superposed with the other layer of panel material 2 before being folded. The sheets of side gusset material 3 are interposed between the layers of panel material 1 and 2. In addition, one of the layers of panel material 1 has a large width W1 while the other layer of panel material 2 has a small width W2. Accordingly, one of the layers of panel material 1 has one of the side edges 11 protruding beyond the corresponding side edge 9 of the other layer of panel material 2 at a distance L widthwise of the webs of panel material 1 and 2, when being superposed with the other layer of panel material 2. The layers of panel material 1 and 2 are then fed as they are. The distance L is predetermined by and equal to the difference (W1−W2) between the widths W1 and W2 of the layers of panel material 1 and 2. The sheet of side gusset material 3 extends widthwise of one of the layers of panel material 1 and has a length corresponding to the width W2 of the other layer of panel material 2. In addition, the sheet of side gusset material 3 is disposed at a position corresponding to that of the other layer of panel material 2. Accordingly, all the sheet of side gusset material 3 is covered with the other layer of panel material 2, as shown in FIG. 4. The sheet of side gusset material 3 extends widthwise of the other layer of panel material 2 to reach the corresponding side edge 9 of the other layer of panel material 2.

The layers of panel material 1 and 2 are then heat sealed or ultrasonic sealed with the sheet of side gusset material 3 by heat seal or ultrasonic seal means 15 at the position of the end portion of side gusset material 3 whenever the webs of panel material 1 and 2 are fed intermittently so that one of the layers of panel material 1 can be adhered to one of the layers of side gusset material 3 while the other layer of panel material 2 can be adhered to the other layer of side gusset material 3. One of the layers of panel material 1 is then guided by the panel material guide means to be folded and folded back.

The panel material guide means includes first guide means by which one of the layers of panel material 1 is guided to be folded along the longitudinal fold line 8 when being fed and after the sheet of side gusset material 3 is supplied. The panel material guide means further includes second guide means by which one of the layers of panel material 1 is guided to be folded back along the longitudinal folded back line 10 when being fed and after being folded so that the folded portion 4 can be formed in one of the layers of panel material 1 and folded into halves.

The first guide means includes guide rollers 16 and 17 and a plate 18, the layers of panel material 1 and 2 passing through the guide roller 16. One of the layers of panel material 1 is then directed to and lowered by the guide roller 17. The other layer of panel material 2 is directed to and lowered by the plate 18. One of the layers of panel material 1 is then directed to and guided by guide rollers 19 and 20 to be folded upward and vertically at a position near one of the side edges 11 thereof. The plate 18 includes an inclined edge 21 with which the other layer of panel material 2 is engaged. In addition, the other layer of panel material 2 is directed to a guide roller 22 and guided by the inclined edge 21 and the guide roller 22 to be folded upward and vertically at a position near the corresponding side edge 9 thereof. The other layer of panel material 2 is then directed to and guided by the guide roller 20 to be folded completely. Furthermore, the layers of panel material 1 and 2 are directed to and raised by a guide roller 23. The layers of panel material 1 and 2 are guided by the guide roller 23 so that one of the layers of panel material 1 can be folded completely. A folded portion 4 is therefore formed in one of the layers of panel material 1. The folded portion 4 has a free side edge 11 formed by one of the side edges 11.

Furthermore, it should be recognized in the apparatus that one of the layers of panel material 1 is folded by the first guide means at a width which corresponds to the distance L between one of the side edges 11 and the corresponding side edge 9. The other layer of panel material 2 is folded by the first guide means at a width which is half as much as the distance L so that one of the side edges 11 can be coincided with the corresponding side edge 9. One of the side edges 11 is then heat sealed with the corresponding side edge 9 by the longitudinal seal means 14. For example, the layers of panel material 1 and 2 are directed to a guide roller 24 after being folded. The longitudinal seal means 14 comprises a longitudinal seal bar disposed above the layers of panel material 1 and 2 and between the guide rollers 23 and 24. The other layer of panel material 2 has been folded and superposed into two layers between which a plate **14*a* is interposed. The layers of panel material 1 and 2 are then sandwiched between the longitudinal seal bar 14, the plate 14*a* and a receiver 14*b* so that one of the side edges 11 can be heat sealed with the corresponding side edge 9 by the heat seal bar 14, whenever the webs of panel material 1 and 2 are fed intermittently. The folded portion 4 is then guided by second guide means to be folded into halves, as described later. It should therefore be noted that the free side edge 11 is heat sealed with the corresponding side edge 9 of the other layer of panel material 2 before the folded portion 4** is folded into halves.

Figure 5:
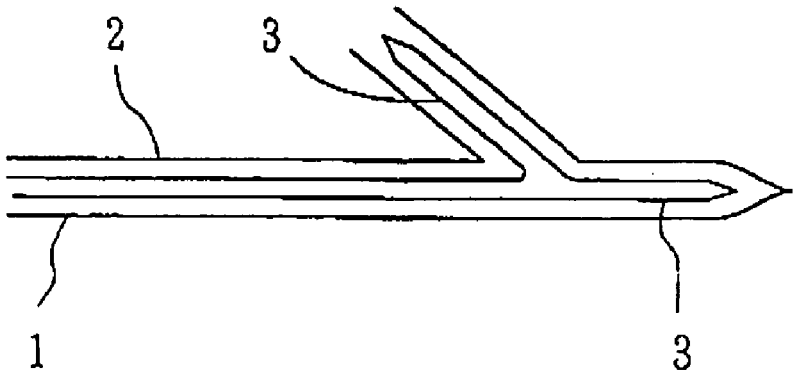
FIG. 5 is a sectional view of the webs of panel material of FIG. 4 when being folded.

It should be reminded that the layers of panel material 1 and 2 have been heat sealed or ultrasonic sealed with the sheet of side gusset material 3 at the position of the end portion of side gusset material 3 so that one of the layers of panel material 1 can be adhered to one of the layers of side gusset material 3 while the other layer of panel material 2 can be adhered to the other layer of side gusset material 3, as described earlier. The other layer of panel material 2 is then folded by the first guide means at the width which is half as much as the distance L between one of the side edges 11 and the corresponding side edge 9. In addition, the sheet of side gusset material 3 includes the end portion by which the auxiliary gusset portion 7 is formed, as also described earlier. The auxiliary gusset portion 7 has a length corresponding the width at which the other layer of panel material 2 is folded by the first guide means. Accordingly, one of the layers of side gusset material 3 is held by one of the layers of panel material 1 while the other layer of side gusset material 3 is pulled and raised by the other layer of panel material 2 to be folded upward when the other layer of panel material 2 is folded upward, as shown in FIG. 5, to make the auxiliary gusset portion 7 opened. Furthermore, one of the layers of panel material 1 is folded by the first guide means at the width which corresponds to the distance L so that the auxiliary gusset portion 7 can be covered with one of the layers of panel material 1 after being opened. The auxiliary gusset portion 7 extends toward and reaches the folded line 8 of one of the layers of panel material 1.

Figure 6:
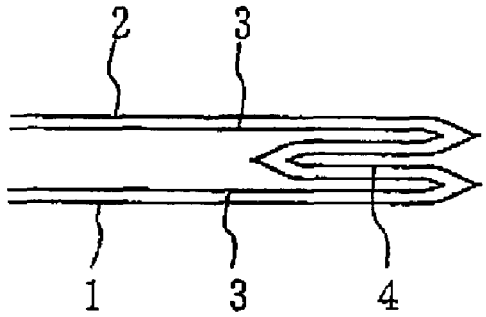
FIG. 6 is a sectional view of one of the layers of panel material of FIG. 5 when being folded back and the other layer of panel material of FIG. 5 when being unfolded.

The second guide means includes a guide roller 25, a plate 26 and pinch rollers 27, the layers of panel material 1 and 2 being directed to the guide roller 25 to be lowered again after the free side edge 11 and the corresponding side edge 9 are heat sealed with each other. In addition, the layers of panel material 1 and 2 pass through the plate 26 including an inclined edge 28 with which the layers of panel material 1 and 2 are engaged at a position near the free side edge 11 and the corresponding side edge 9. The layers of panel material 1 and 2 are then directed to the pinch rollers 27 so that one of the layers of panel material 1 can be guided by the inclined edge 28, the guide roller 25 and the pinch rollers 27 to be folded back upward and vertically. The other layer of panel material 2 is guided by the inclined edge 28, the guide roller 25 and the pinch rollers 27 to be unfolded upward and vertically. The layers of panel material 1 and 2 are then directed to a guide roller 29. One of the layers of panel material 1 is guided by the guide roller 29 to be folded back completely so that the folded portion 4 can be folded into halves. The other layer of panel material 2 is guided by the guide roller 29 to be unfolded for restoration. At the same time, the other layer of side gusset material 3 is unfolded by the other layer of panel material 2 so that the auxiliary gusset portion 7 can be closed by the other layer of side gusset material 3 to stride the folded portion 4, as shown in FIG. 6. Accordingly, one of the layers of side gusset material 3 is interposed between one of the layers of panel material 1 and the folded portion 4, along with one of the layers of auxiliary gusset portion 7. The other layer of side gusset material 3 is interposed between the other layer of panel material 2 and the folded portion 4, along with the other layer of auxiliary gusset portion 7. The folded portion 4 is therefore combined with the sheet of side gusset material 3 and disposed between the layers of panel material 1 and 2.

It should therefore be understood in the apparatus that the folded portion 4 is combined with the sheet of side gusset material 3 by means of folded and folded back procedures in which one of the layers of panel material 1 is folded and then folded back by the first and second guide means. In addition, the free side edge 11 and the corresponding side edge 9 are heat sealed with each other by the longitudinal seal bar 14, as described earlier. No discrepancy is therefore brought in position between the free side edge 11 and the corresponding side edge 9 when one of the layers of panel material 1 is folded back and the other layer of panel material 2 is unfolded.

The layers of panel material 1 and 2 are then directed to the feed rollers 13 through cross seal means 30 and heat sealed with the sheet of side gusset material 3 by the cross seal means 30 whenever the webs of panel material 1 and 2 are fed intermittently. The auxiliary gusset portion 7 is also heat sealed with the folded portion 4 of one of the layers of panel material 1 by the cross seal means 30. It should be noted that the heat seal portions 6 of FIG. 7 are formed by this step. The cross seal means 30 comprises a pair of cross seal bars between which the layers of panel material 1 and 2 and the sheet of side gusset material 3 are sandwiched so that the layers of panel material 1 and 2 can be heat sealed with the sheet of side gusset material 3 by the cross seal bars 30. The auxiliary gusset portion 7 is also heat sealed with the folded portion 4 of one of the layers of panel material 1 by the cross seal bars 30. The layers of panel material 1 and 2 may be heat sealed with the sheet of side gusset material 3 in twice. In this case, the auxiliary gusset portion 7 is also heat sealed with the folded portion 4 of one of the layers of panel material 1 in twice. Furthermore, the layers of panel material 1 and 2 are sandwiched between a pair of longitudinal seal bars 14 at a position downstream of the cross seal means 30 so that the free side edge 11 can be heat sealed with the corresponding side edge 9 again and one of the layers of panel material 1 can be heat sealed with the folded portion 4 thereof along the folded line 8. The webs of panel material 1 and 2 are then cut widthwise thereof by a cutter 31 whenever being fed intermittently at a position of the sheet of side gusset material 3. In the embodiment, the layers of panel material 1 and 2 and the sheet of side gusset material 3 are cut along the longitudinal centerline of the sheet of side gusset material 3. It should be noted that the side edges 5 of FIG. 8 are formed by this step.

In the embodiment, each of the webs of panel material 1 and 2 and the sheets of side gusset material 3 comprises a laminated film composed of a base material such as nylon and a sealant such as polyethylene or polypropylene which is laminated on the base material. The layers of panel material 1 and 2 have inner surfaces formed by the sealant and outer surfaces formed by the base material. The sheets of side gusset material 3 have outer surfaces formed by the sealant and inner surfaces formed by the base material when being folded into halves. In addition, one of the layers of panel material 1 includes one of the side edges 11 coincided with the corresponding edge 9 of the other layer of panel material 2, as described earlier. It should be therefore noted that one of the side edges 11 can be heat sealed with the corresponding side edge 9 of the other layer of panel material 2 by the longitudinal seal means 14. Furthermore, the layers of panel material 1 and 2 can be heat sealed with the sheet of side gusset material 3 by the cross seal means 30. The auxiliary gusset portion 7 can also be heat sealed with the folded portion 4 by the cross seal means 30.

The apparatus can therefore make the plastic bags each of which includes the side gusset portions 3 and the bottom gusset portion 4. The bottom gusset portion 4 is formed by the folded portion of one of the layers of panel material 1. The sheets of side gusset material 3 are therefore merely required to be supplied. No web of bottom gusset material is required to be supplied. The apparatus need therefore not to involve bottom gusset material supply means, to be simple in structure and low in cost. In addition, the apparatus can be compact in size. A large space is therefore not required for installation.

Furthermore, the apparatus can make the panel portion 1 and 2 and the bottom gusset portion 4 printed by making the webs of panel material 1 and 2 printed. In this case, no discrepancy is brought in print between the panel portion 1 and 2 and the bottom gusset portion 4 by reason that the bottom gusset portion 4 is formed by the folded portion of one of the layers of panel material 1.

Figure 9:
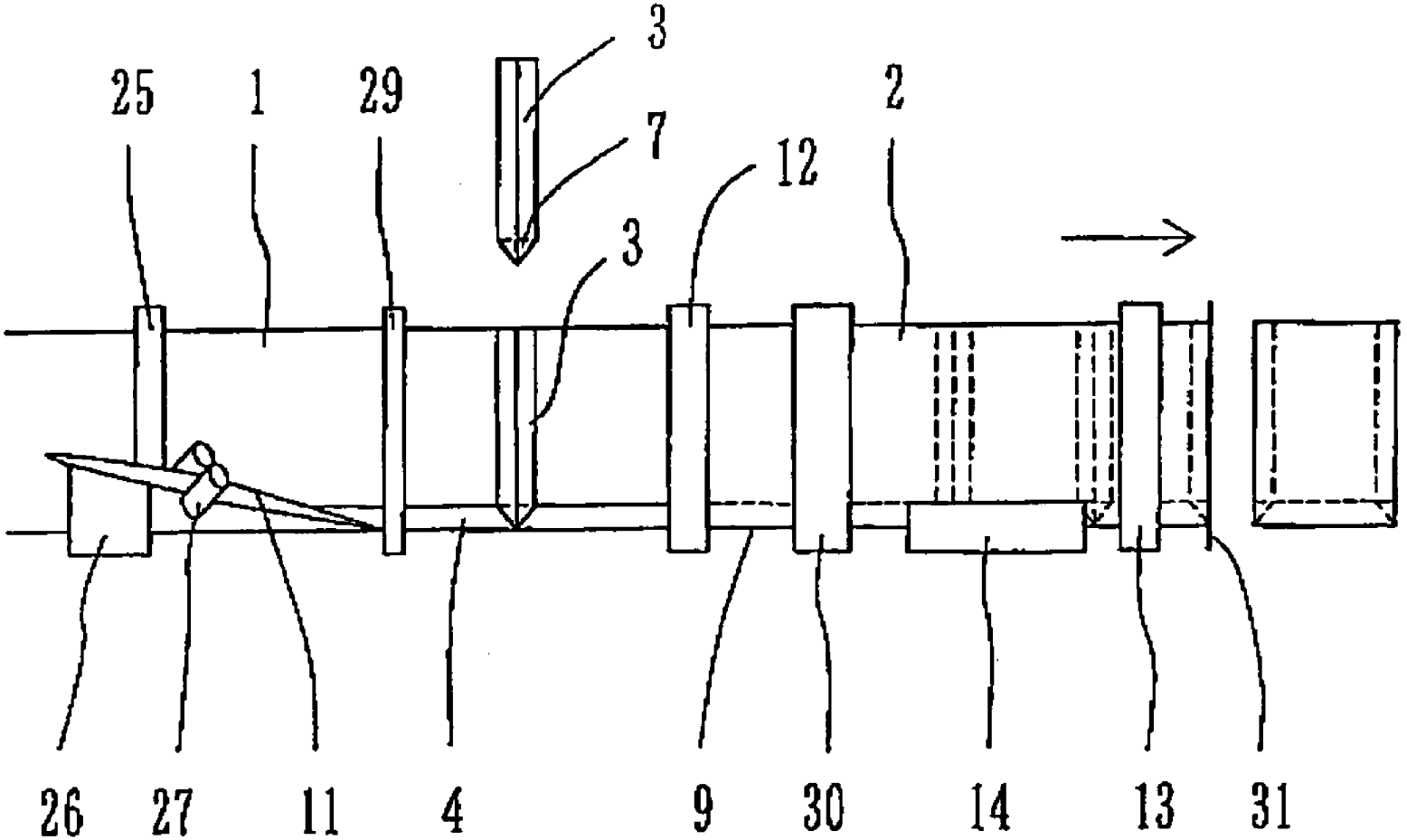
FIG. 9 is a plan view of other embodiment.

In other embodiment shown in FIG. 9, one of the layers of panel material 1 is folded and folded back by panel material guide means before the layers of panel material 1 and 2 are superposed with each other. The panel material guide means has the same structure as that of FIG. 1. The sheets of side gusset material 3 are then supplied to and put on one of the layers of panel material 1 by side gusset material supply means one by one, to extend widthwise thereof. The side gusset material supply means has the same structure as that of Japanese Laid-Open Patent Publication No. 254,984 of 2000, in which each of the sheets of side gusset material 3 is folded into halves on the opposite sides of the longitudinal centerline to be superposed into two layers. The sheet of side gusset material 3 includes an end portion folded at an angle of 45°. The end portion is folded into halves and interposed between the layers of side gusset material 3 so that the auxiliary gusset portion 7 can be formed by the end portion. The auxiliary gusset portion 7 then strides the folded portion 4 of one of the layers of panel portion 1 in the same manner as the apparatus of the publication in which the auxiliary gusset portion strides not the folded portion but a web of bottom gusset material.

Figure 10:
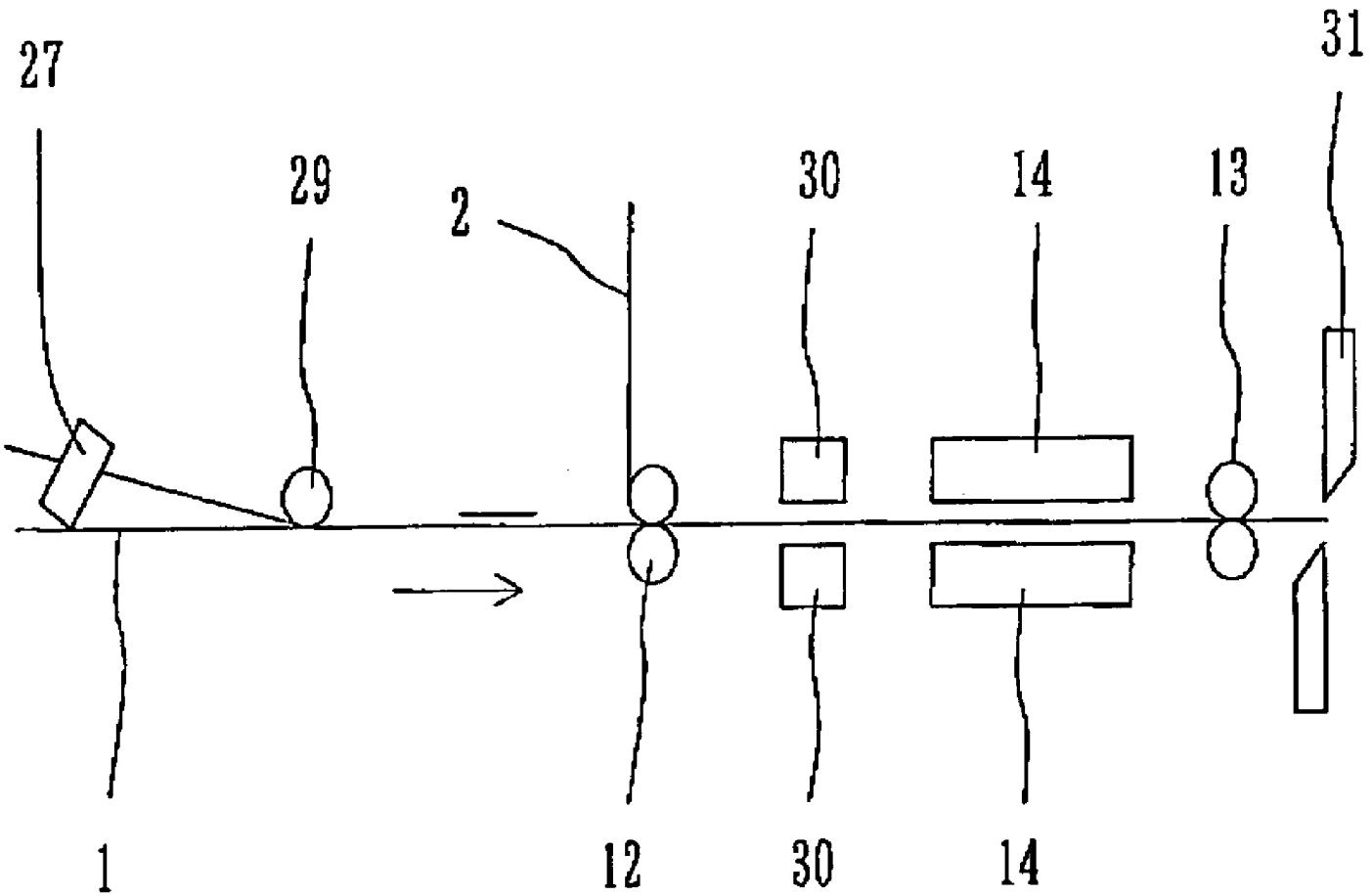
FIG. 10 is a side view of the apparatus of FIG. 9.

One of the layers of panel material 1 is then directed to the feeding roller 12. The other layer of panel material 2 is also directed to the feeding roller 12 so that the layers of panel material 1 and 2 are superposed with each other, as shown in FIG. 10. The folded portion 4 is therefore interposed between the layers of panel material 1 and 2. The sheet of side gusset material 3 is also interposed between the layers of panel material 1 and 2. One of the side edges 11 is then coincided and heat sealed with the corresponding side edge 9. For example, the layers of panel material 1 and 2 are directed to the feeding roller 13 through cross seal means 30 and longitudinal seal means 14 and heat sealed with the sheet of side gusset material 3 by the cross seal means 30 whenever being fed intermittently. The auxiliary gusset portion 7 and the folded portion 4 are also heat sealed with each other by the cross seal means 30. In addition, one of the side edges 11 and the corresponding side edge 9 are heat sealed with each other by the longitudinal seal means 14 whenever the webs of panel material 1 and 2 are fed intermittently. One of the layers of panel material 1 is also heat sealed with the folded portion 4 thereof along the folded line 8. The webs of panel material 1 and 2 and the sheet of side gusset material 3 are then cut widthwise of the webs of panel material 1 and 2 by the cutter 31 whenever the webs of panel material 1 and 2 are fed intermittently.

Accordingly, the bottom gusset portion 4 is formed by the folded portion 4 of one of the layers of panel material 1 in the apparatus of FIG. 9 as in the case of the apparatus of FIG. 1. The sheets of side gusset material 3 are therefore merely required to be supplied. No web of bottom gusset material is required to be supplied. The apparatus can therefore be simple in structure and low in cost. In addition, the apparatus can be compact in size. A large space is therefore not required for installation.

Figure 11:
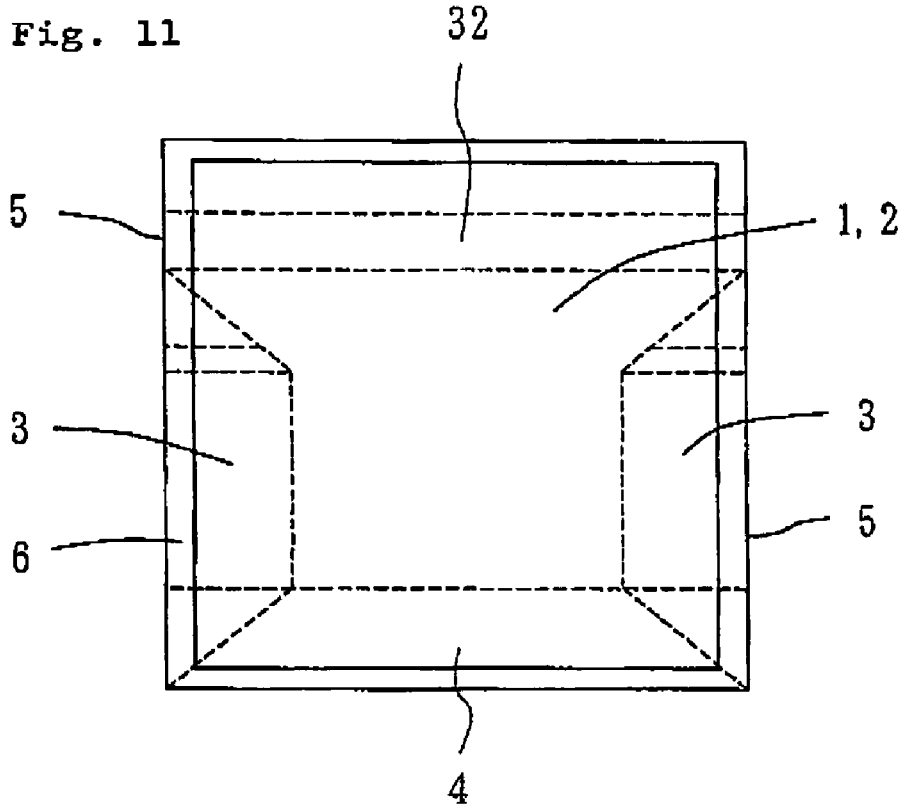
FIG. 11 is an explanatory view of other plastic bag.

In the apparatus of FIG. 1 or FIG. 9, a fastener 32 can be interposed between the layers of panel material 1 and 2 to be incorporated into the plastic bag, as shown in FIG. 11. The fastener 32 may be called a zipper and has been used generally in itself. It includes a male member formed integrally with a tape and fitted into a female member which is also formed integrally with a tape. The layers of panel material 1 and 2 are heat sealed with the tapes of male and female members respectively. The plastic bag can therefore be opened and closed by the fastener 32.

Figure 12:
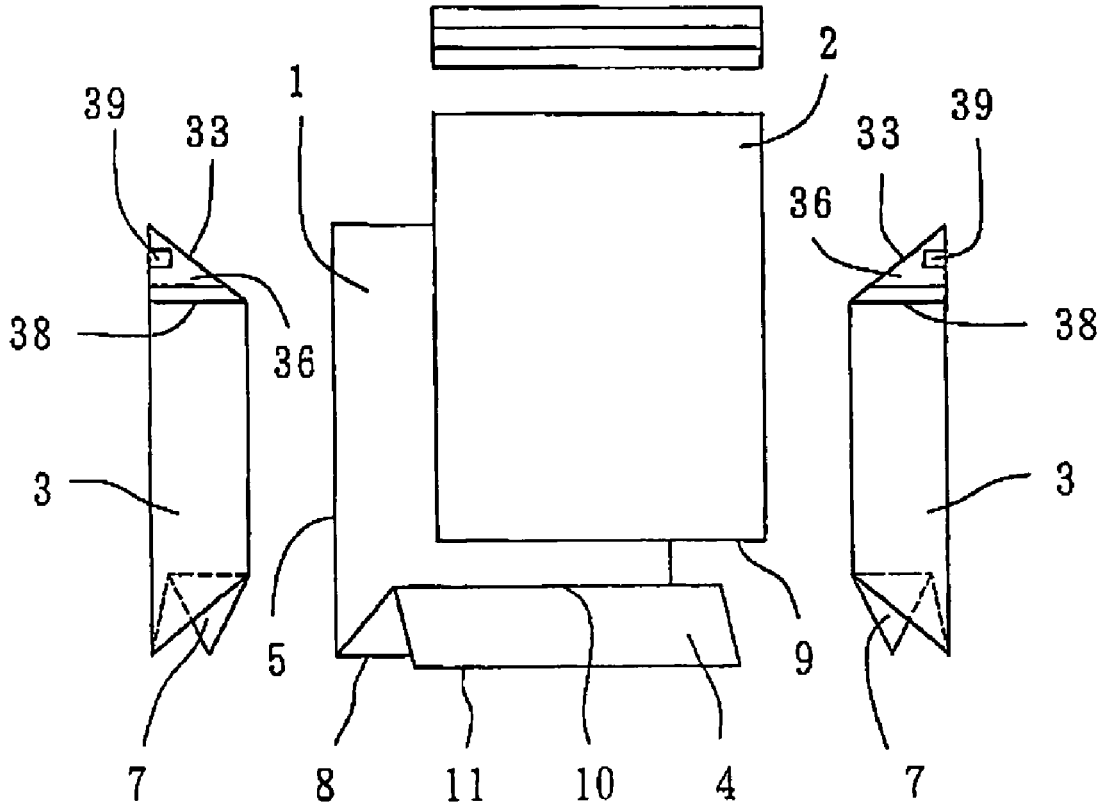
FIG. 12 is an explosive view of the plastic bag of FIG. 11.
Figure 13:
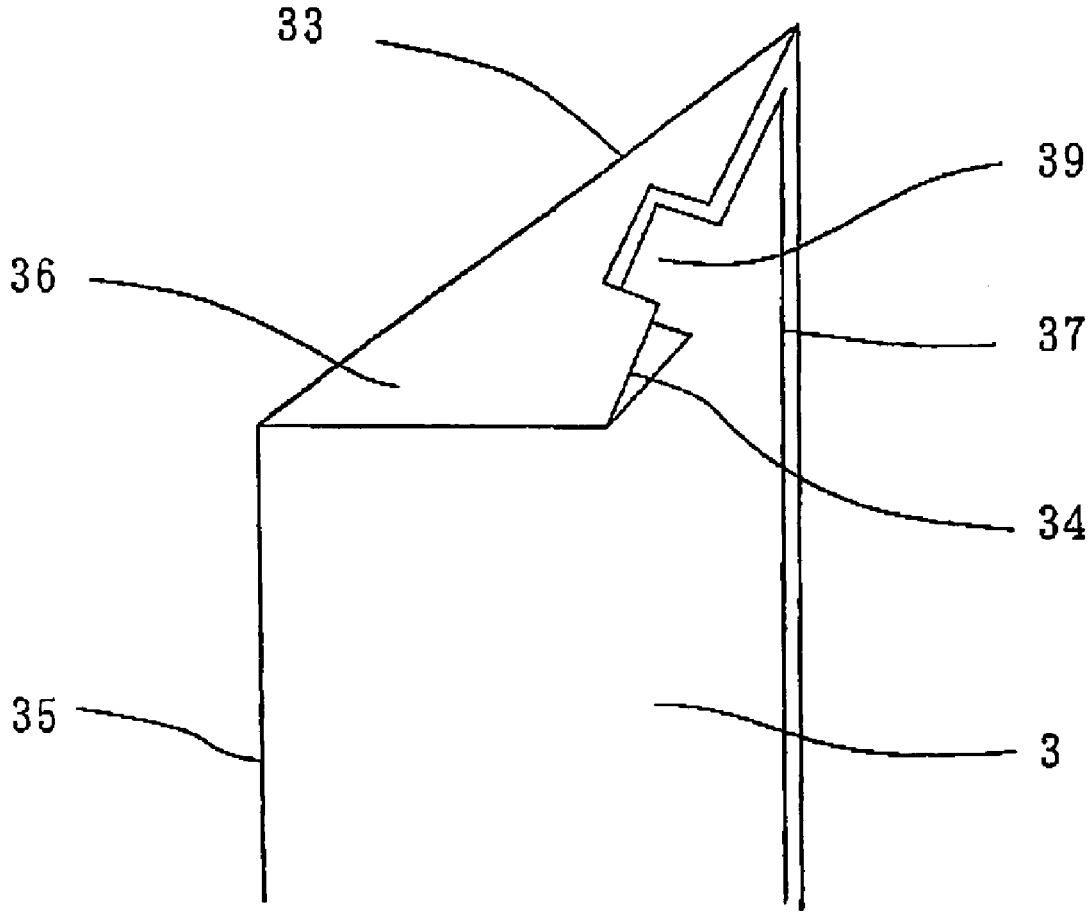
FIG. 13 is an enlarged view of the sheet of side gusset material of FIG. 12.

In addition, in the plastic bag of FIG. 11, each of the side gusset portions 3 has opposite end portions one of which is folded obliquely along a folded line 33 as it is folded into halves at a position near the fastener 32, as shown in FIG. 12 and FIG. 13. A triangular flap 36 is therefore formed by the end portion to be shaped into a triangle having a base formed by the folded line 33. The triangle has an apex formed by an intersection between the end edge 34 and the folded inner edge 35 of the side gusset portion 3. The folded line 33 comprises a bisector which reaches intersections between the end edge 34 and the open outer edges 37 of the side gusset portion 3 to bisect an angle between the end edge 34 and the open outer edges 37. The triangle flap 36 is therefore shaped into an isosceles triangle having the base formed by the folded line 33. The side gusset portion 3 has the other end portion folded at an angle of 45°, by which the auxiliary gusset portion 7 is formed, as in the case of the plastic bag of FIG. 8.

In this case, the layers of panel portion 1 and 2, the side gusset portion 3 and the triangular flap 36 are heat sealed respectively by the cross seal means 30. One of the layers of panel portion 2 is therefore heat sealed with the triangular flap 36 along the side edges 5 of panel portion 1 and 2. The triangular flap 36 is heat sealed with the side gusset portion 3 along the side edges 5 of panel portion 1 and 2. The other layer of panel portion 1 is heat sealed with the side gusset portion 3 along the side edges 5 of panel portion 1 and 2 on the opposite side to the triangular flap 36. The triangular flap 36 may be heat sealed with the side gusset portion 3 along the folded hypotenuse of triangular flap 36 so that a heat sealed portion 38 can be formed. Hole or notch means 39 may be formed in the triangular flap 36 so that one of the layers of panel portion 2 can be heat sealed with the side gusset portion 3 through the hole or notch means 39.

It should be noted that the apparatus is arranged to successively make the plastic bags one by one in the embodiments of FIG. 1 and FIG. 9. On the contrary, the apparatus may be arranged to successively make the plastic bags two by two.

In order to successively make the plastic bags two by two, the apparatus should include panel material guide means by which one of the layers of panel material 1 is guided to be folded and folded back along the longitudinal folded line 8 and the longitudinal folded back line 10 near one of the side edges thereof when being fed so that a first folded portion 4 can be formed in one of the layers of panel material 1 and folded into halves, the first folded portion 4 having a first free side edge 11 formed by one of the side edges, as in the case of the apparatus of FIG. 1 and FIG. 9. In addition, one of the layers of panel material 1 should be guided by the panel material guide means to be folded and folded back along a longitudinal folded line and a longitudinal folded back line near the other side edge thereof when being fed so that a second folded portion can be formed in one of the layers of panel material 1 and folded into halves, the second folded portion having a second free side edge formed by the other side edge. The first and second folded portions are interposed between the layers of panel material 1 and 2.

The panel material guide means should comprise first and second guide means by which one of the layers of panel material 1 is guided to be folded and then folded back so that the first and second folded portions can be combined with the sheet of side gusset material 3 by means of folded and folded back procedures in which one of the layers of panel material 1 is folded and then folded back by the first and second guide means. The sheet of side gusset material 3 should includes auxiliary gusset portions 7 formed by the opposite end portions thereof, striding the first and second folded portions 4 and interposed between the layers of panel material 1 and 2.

Furthermore, the apparatus should include longitudinal seal means by which the first free side edge 11 is heat sealed with the corresponding side edge 9 of the other layer of panel material 2 before or after the first folded portion 4 is folded into halves. The second free side edge should be heat sealed with the corresponding side edge of the other layer of panel material 2 by the longitudinal seal means before or after the second folded portion is folded into halves. In addition, the layers of panel material 1 and 2 should be heat sealed with the sheet of side gusset material 3 by the cross seal means 30. The first and second auxiliary gusset portions 7 should also be heat sealed with the first and second folded portions 4 by the cross seal means 30. The webs of panel material 1 and 2 and the sheets of side gusset material 3 should then be slit along the longitudinal centerline of panel material 1 and 2 and cut widthwlse of the webs of panel material 1 and 2 by the cutter 31 to successively make the plastic bags two by two.

Figure 14:
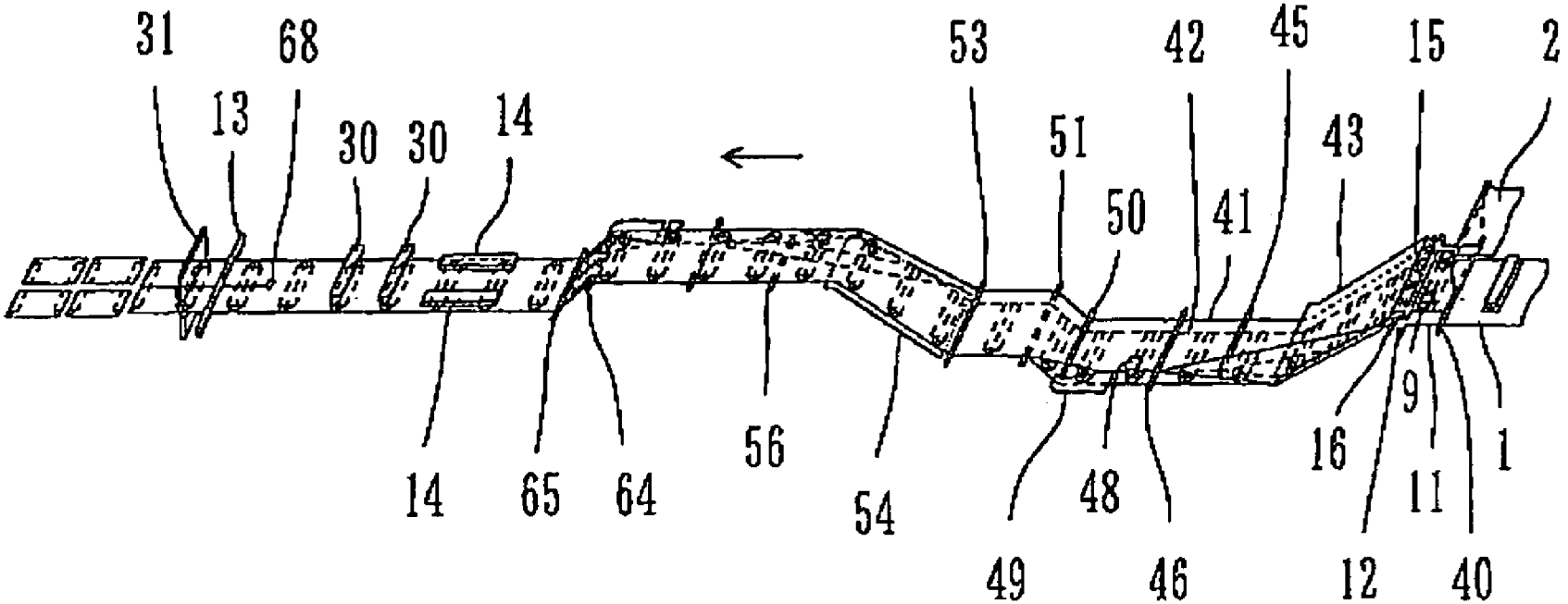
FIG. 14 is a perspective view of other embodiment.
Figure 15:
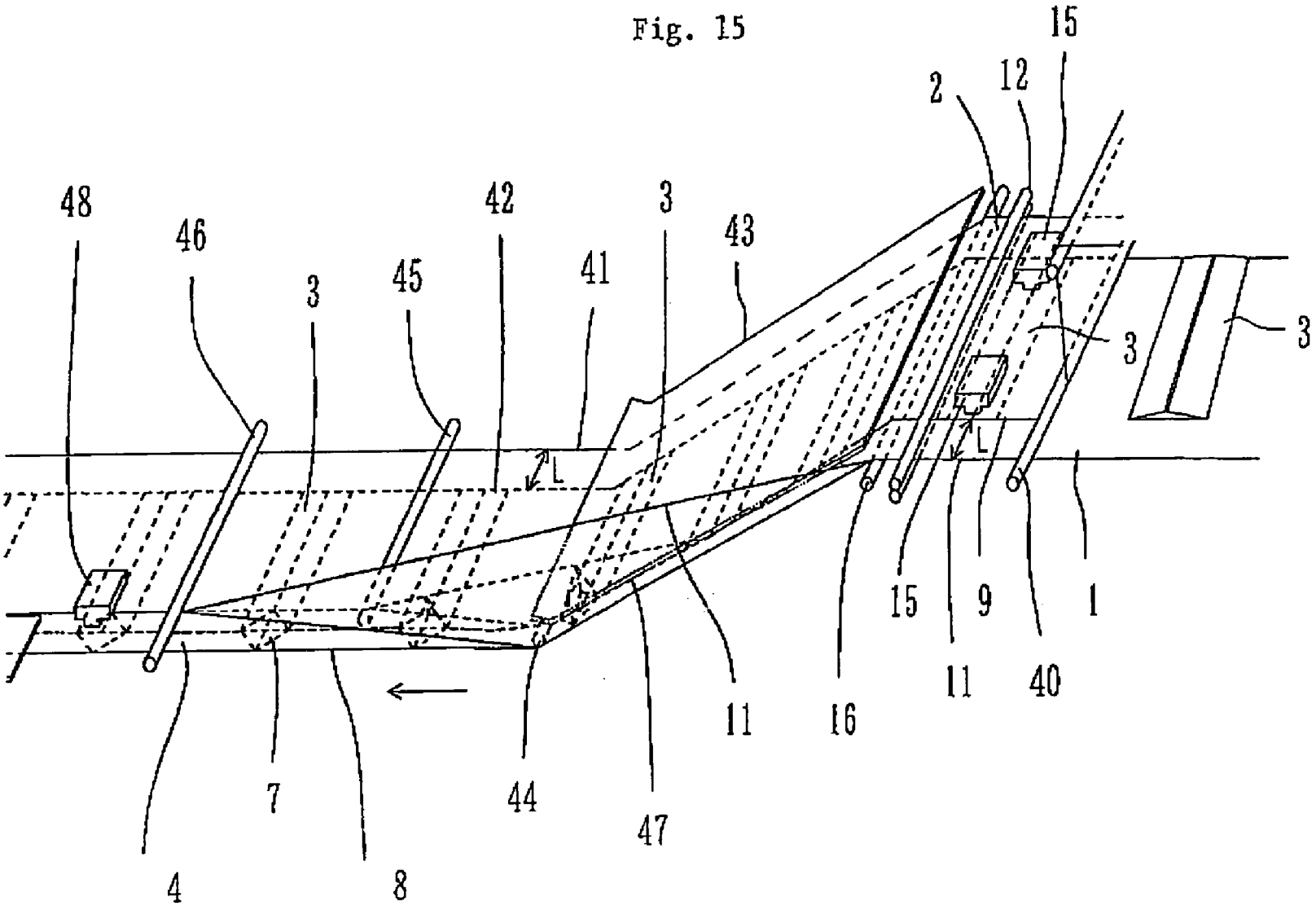
FIG. 15 is an enlarged view of a step in which the webs of panel material of FIG. 14 are folded.

On the other hand, in other embodiment shown in FIG. 14, the webs of panel material 1 and 2 are directed to a guide roller 40 to be superposed into two layers. In addition, the webs of panel material 1 and 2 are directed to the feeding rollers 12 and 13 and fed longitudinally thereof, as in the case of the apparatus of FIG. 1. The feeding rollers 12 and 13 are rotated intermittently so that the webs of panel material 1 and 2 can be fed intermittently. However, unlike the apparatus of FIG. 1, the layers of panel material 1 and 2 have the same width in the apparatus of FIG. 14. In addition, the layers of panel material 1 and 2 are superposed with each other to be different in position from each other at a distance L widthwise thereof, as shown in FIG. 15. Accordingly, one of the layers of panel material 1 has opposite side edges one of which protrudes beyond the corresponding side edge 9 of the other layer of panel material 2 at a distance L widthwise of the webs of panel material 1 and 2. The other layer of panel material 2 has the other side edge 41 protruding beyond the corresponding side edge 42 of one of the layers of panel material 1 at a distance L widthwise of the webs of panel material 1 and 2. The sheet of side gusset material 3 is supplied to and put on one of the layer of panel material 1 to extend widthwise thereof, whenever the webs of panel material 1 and 2 are intermittently fed and before the layers of panel material 1 and 2 are superposed with each other. It should therefore be noted that the sheet of side gusset material 3 is then interposed between the layers of panel material 1 and 2. The sheet of side gusset material 3 has a length less than the width of the webs of panel material 1 and 2 to reach the corresponding side edge 9 of the other layer of panel material 2 and the corresponding side edge 42 of one of the layers of panel material 1. In addition, the sheet of side gusset material 3 has a double width, which is previously folded into halves on the opposite sides of the longitudinal centerline to be superposed into two layers, as in the case of the apparatus of FIG. 1. However, in the apparatus of FIG. 15, the sheet of side gusset material 3 includes opposite end portions not folded at the angle of 45°, before being supplied to one of the layers of panel material 1. The sheet of side gusset material therefore includes no auxiliary gusset portion 7.

The layers of panel material 1 and 2 are then heat sealed or ultrasonic sealed with the sheet of side gusset material 3 by heat seal or ultrasonic seal means 15 at the position of one of the end portions of the sheet of side gusset material 3 so that one of the layers of panel material 1 can be adhered to one of the layers of side gusset material 3 while the other layer of panel material 2 can be adhered to the other layer of side gusset material 3. At the same time, the layers of panel material 1 and 2 are heat sealed or ultrasonic sealed with the sheet of side gusset material 3 by the heat seal or ultrasonic seal means 15 at the position of the other end portion of the sheet of side gusset material 3 so that one of the layers of panel material 1 can be adhered to one of the layers of side gusset material 3 while the other layer of panel material 2 can be adhered to the other layer of side gusset material 3.

One of the layers of panel material 1 is then guided by panel material guide means to be folded and folded back along the longitudinal fold line 8 and the longitudinal folded back line 10 near one of the side edges 11 of the web of panel material 1 when being fed so that a first folded portion 4 can be formed in one of the layers of panel material 1 and folded into halves. The panel material guide means comprises first and second guide means.

In the embodiment, the first guide means includes a plate 43 and guide rollers 44, 45 and 46, the layers of panel material 1 and 2 passing through the guide roller 16. The layers of panel material 1 and 2 are then directed to and lowered by the plate 43 and the guide rollers 44, 45 and 46. In addition, one of the layers of panel material 1 is guided by the guide roller 44 to be folded upward and vertically at a position near one of the side edges 11 thereof. The plate 43 includes an inclined edge 47 with which the other layer of panel material 2 is engaged. The other layer of panel material 2 is guided by the inclined edge 47 to be folded upward and vertically at a position near the corresponding side edge 9 thereof. The other layer of panel material 2 is then directed to and guided by the guide roller 45 to be folded completely. Furthermore, the layers of panel material 1 and 2 are directed to and guided by the guide roller 46 so that one of the layers of panel material an be folded completely. One of the layers of panel material 1 is therefore folded along the longitudinal folded line 8 at the position near one of the side edges 11 thereof so that the folded portion 4 can be formed in one of the layers of panel material 1.

It should be noted in the apparatus that one of the layers of panel material 1 is folded by the first guide means at a width which corresponds to the distance L between one of the side edges 11 and the corresponding side edge 9 of the webs of panel material 1 and 2, as in the case of the apparatus of FIG. 1. The other layer of panel material 2 is folded by the first guide means at a width which is half as much as the distance L so that one of the side edges 11 can be coincided with the corresponding side edge 9. Furthermore, the layers of panel material 1 and 2 have been heat sealed or ultrasonic sealed with the sheet of side gusset material 3 at the position of one of the end portions of side gusset 3 so that one of the layers of panel material 1 can be adhered to one of the layers of side gusset material 3 while the other layer of panel material 2 can be adhered to the other layer of side gusset material 3, as described earlier. Accordingly, one of the layers of side gusset material 3 is held by one of the layers of panel material 1 while the other layer of side gusset material 3 is pulled and raised by the other layer of panel material 2 to be folded upward and vertically when the other layer of panel material 2 is folded upward and vertically, to make the layers of side gusset material 3 opened so that an auxiliary gusset portion 7 can be formed by this step. One of the layers of panel material 1 is then folded completely so that the auxiliary gusset portion 7 can be covered with one of the layers of panel material 1.

Figure 16:
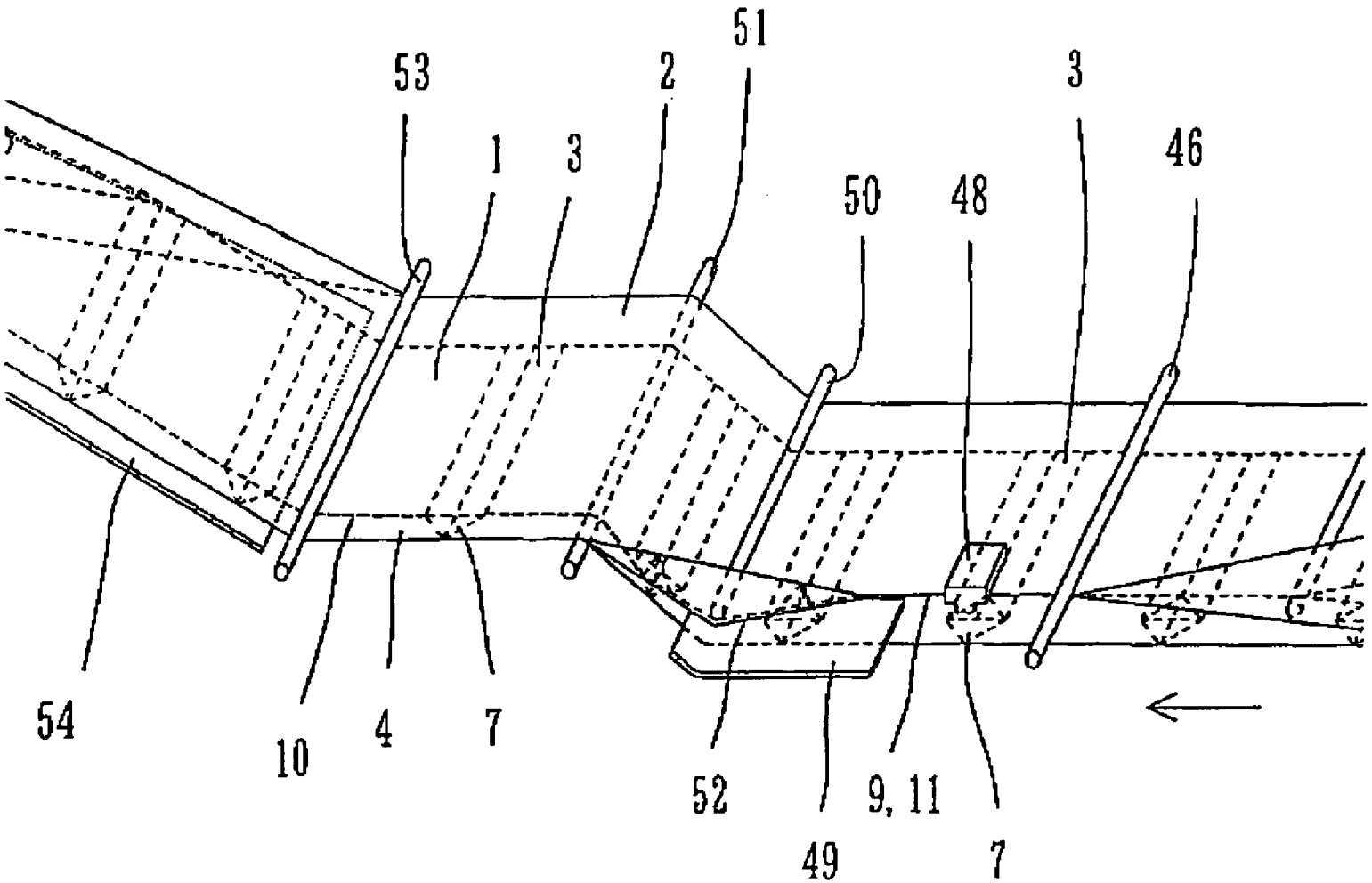
FIG. 16 is an enlarged view of a step next to that of FIG. 15.

One of the layers of panel material 1 is then heat sealed or ultrasonic sealed with and adhered to the auxiliary gusset portion 7 by heat seal or ultrasonic seal means 48. The second guide means comprises a plate 49 and guide rollers 50 and 51, as shown in FIG. 16. The layers of panel material 1 and 2 are directed to the guide roller 51 through the plate 49 and the guide roller 50 to be raised again. The plate 49 includes an inclined edge 52 with which the layers of panel material 1 and 2 are engaged at a position near one of the side edges 11 and the corresponding side edge 9. One of the layers of panel material 1 is guided by the inclined edge 52 to be folded back upward and vertically. The other layer of panel material 2 is guided by the inclined edge 52 to be unfolded upward and vertically. One of the layers of panel material 1 is then guided by the guide roller 51 to be folded back completely so that the first folded portion 4 can be folded into halves. The other layer of panel material 2 is guided by the guide roller 51 to be unfolded for restoration. It should therefore be noted that one of the layers of panel material 1 is folded back along the longitudinal folded back line 10 so that the first folded portion 4 can be formed in one of the layers of panel material 1 and folded into halves. The first folded portion 4 is interposed between the layers of panel material 1 and 2. At the same time the layers of side gusset material 3 and auxiliary gusset portion 7 are closed by the layers of panel material 1 and 2 to stride the first folded portion 4. One of the layers of side gusset material 3 is therefore interposed between one of the layers of panel material 1 and the first folded portion 4, along with one of the layers of auxiliary gusset portion 7. The other layer of side gusset material 3 is interposed between the other layer of panel material 2 and the first folded portion 4, along with the other layer of auxiliary gusset portion 7.

The other layer of panel material 2 is then guided by panel material guide means to be folded and folded back along a longitudinal folded line and a longitudinal folded back line near the other side edges 41 of the web of panel material 2 when being fed so that a second folded portion can be formed in the other layer of panel material 2 and folded into halves. The panel material guide means comprises first and second guide means.

Figure 17:
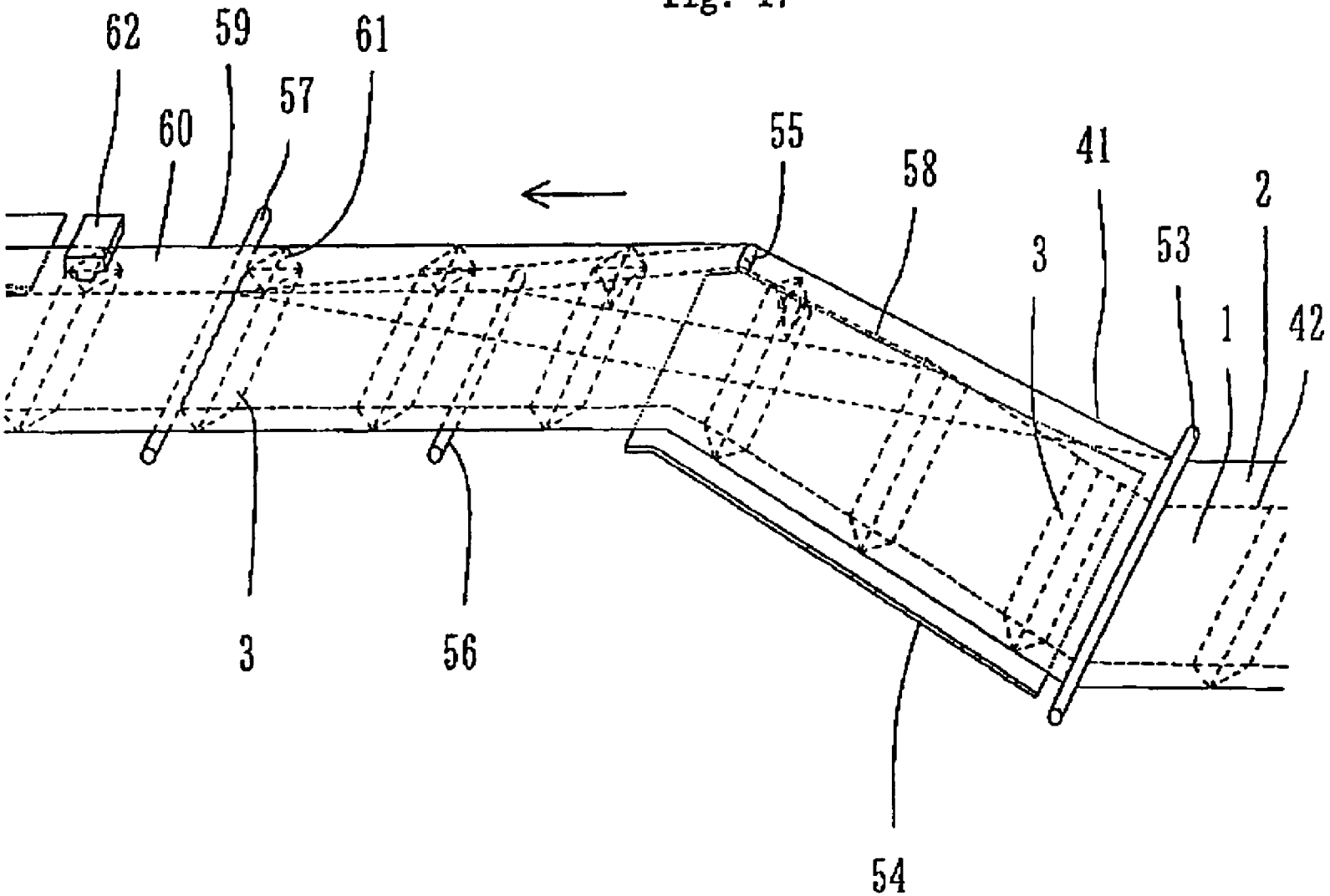
FIG. 17 is an enlarged view of a step next to that of FIG. 16.

In the embodiment, the first guide means includes a guide roller 53, a plate 54 and guide rollers 55, 56 and 57, as shown in FIG. 17, the layers of panel material 1 and 2 passing through the guide roller 53. The layers of panel material 1 and 2 are then directed to the guide rollers 55, 56 and 57 through the plate 54 to be raised again. In addition, the other layer of panel material 2 is guided by the guide roller 56 to be folded vertically at a position near the other side edge 41 of the web of panel material 2. Contrary to the preceding steps, the other layer of panel material 2 is folded downward. The plate 54 includes an inclined edge 58 with which one of the layers of panel material 1 is engaged. One of the layers of panel material 1 is guided by the inclined edge 54 to be folded vertically. One of the layers of panel material 1 is also folded downward. One of the layers of panel material 1 is then guided by the guide roller 56 to be folded completely. The other layer of panel material 2 is guided by the guide roller 57 to be folded completely. The other layer of panel material 2 is therefore folded along the longitudinal folded line 59 at the position near the other side edge 41 of the web of panel material 2 so that a second folded portion 60 can be formed in the other layer of panel material 2.

In this connection, the other layer of panel material 2 is folded by the first guide means at a width which corresponds to the distance L between the other side edge 41 and the corresponding side edge 42 of the webs of panel material 1 and 2, as in the case of the preceding steps. One of the layers of panel material 1 is folded by the first guide means at a width which is half as much as the distance L so that the other side edge 41 can be coincided with the corresponding side edge 42. Furthermore, the webs of panel material 1 and 2 have been heat sealed or ultrasonic sealed with the sheet of side gusset material 3 at the position of the other end portion of side gusset 3 so that one of the layers of panel material 1 can be adhered to one of the layers of side gusset material 3 while the other layer of panel material 2 can be adhered to the other layer of side gusset material 3, as described earlier, one of the layers of side gusset material 3 is therefore pulled and lowered by one of the layers of panel material 1 to be folded downward and vertically when one of the layers of panel material 1 is folded downward and vertically while the other layer of side gusset material 3 is held by the other layer of panel material 2, to make the layers of side gusset material 3 opened so that an auxiliary gusset portion 61 can be formed by this step. The other layer of panel material 2 is then folded completely so that the auxiliary gusset portion 61 can be covered with the other layer of panel material 2.

Figure 18:
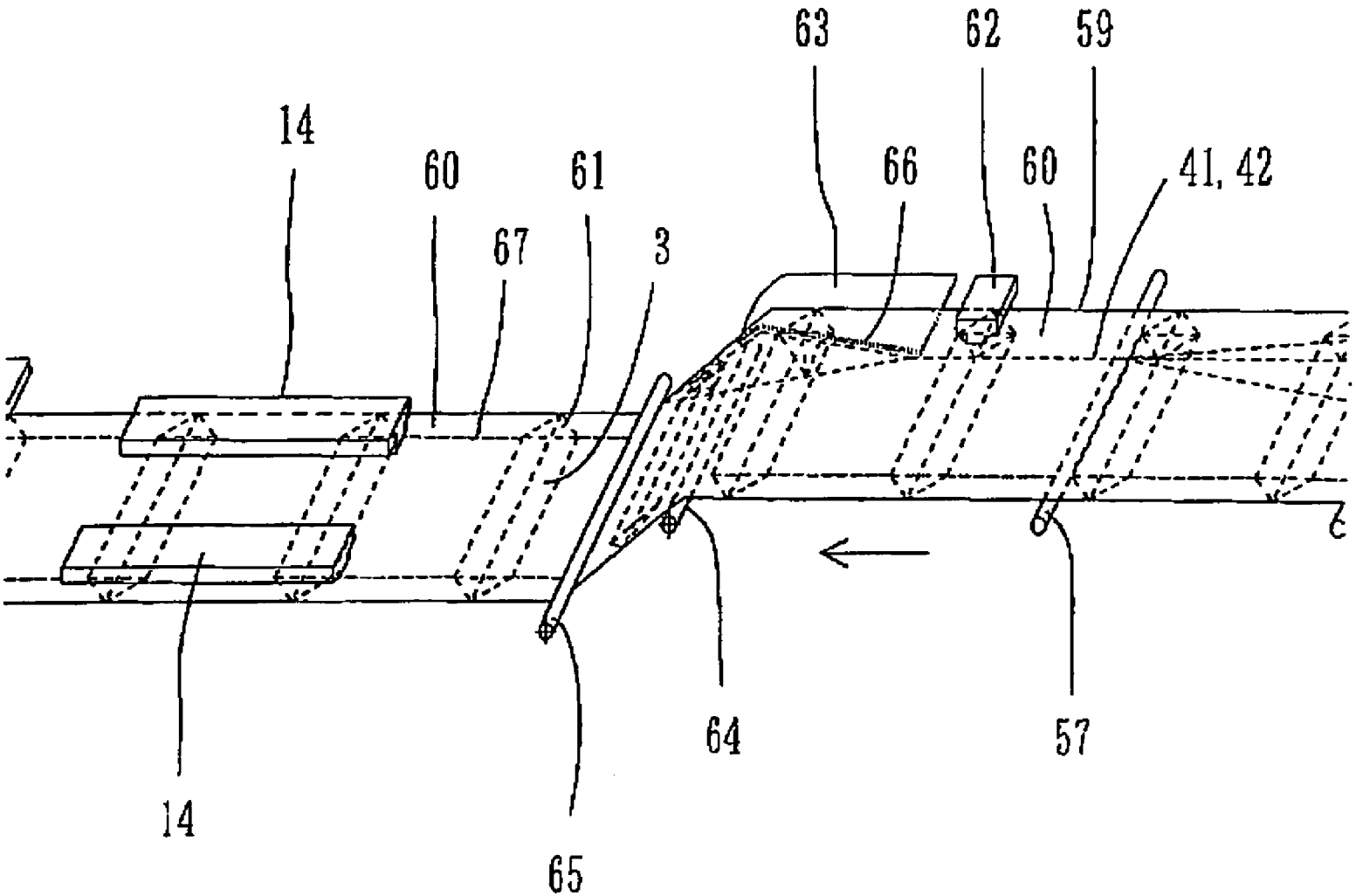
FIG. 18 is an enlarged view of a step next to that of FIG. 17.

The other layer of panel material 2 is then heat sealed or ultrasonic sealed with and adhered to the auxiliary gusset portion 61 by heat seal or ultrasonic seal means 62. The second guide means comprises a plate 63 and guide rollers 64 and 65, as shown in FIG. 18. The layers of panel material 1 and 2 are directed to the guide roller 65 through the plate 63 and the guide roller 64 to be lowered again. The plate 63 includes an inclined edge 66 with which the layers of panel material 1 and 2 are engaged at the position near the other side edges 41 and the corresponding side edge 42. The other layer of panel material 2 is guided by the inclined edge 66 to be folded back vertically. One of the layers of panel material 1 is guided by the inclined edge 66 to be unfolded vertically. The other layer of panel material 2 is folded back downward. One of the layers of panel material 1 is also unfolded downward. The other layer of panel material 2 is then guided by the guide roller 65 to be folded back completely so that the second folded portion 60 can be folded into halves. One of the layers of panel material 1 is guided by the guide roller 65 to be unfolded for restoration. It should therefore be noted that the other layer of panel material 2 is folded back along the longitudinal folded back line 67 so that the second folded portion 60 can be formed in the other layer of panel material 2 and folded into halves. The second folded portion 60 is interposed between the layers of panel material 1 and 2. At the same time, the auxiliary gusset portion 61 is closed by the layers of panel material 1 and 2 to stride the second folded portion 60. One of the layers of side gusset material 3 is therefore interposed between ones of the layers of panel material 1 and second folded portion 60, along with one of the layers of auxiliary gusset portion 61. The other layer of side gusset material 3 is interposed between the other layers of panel material 2 and second folded portion 60, along with the other layer of auxiliary gusset portion 61.

It should therefore be noted in the apparatus that the first folded portion 4 is combined with the sheet of side gusset material 3 by means of folded and folded back procedures in which one of the layers of panel material 1 is folded and then folded back by the first and second guide means. The first folded portion 4 is interposed between the layers of panel material 1 and 2. The second folded portion 60 is combined with the sheet of side gusset material 3 by means of folded and folded back procedures in which the other layer of panel material 2 is folded and then folded back by the first and second guide means. The second folded portion 60 is interposed between the layers of panel material 1 and 2.

The free side edges 11 and 41 are then heat sealed with the corresponding side edges 9 and 42 by longitudinal seal means 14 whenever the webs of panel material 1 and 2 are fed intermittently. The layers of panel material 1 and 2 are heat sealed with the sheet of side gusset material 3 by cross seal means 30. The auxiliary gusset portions 7 and 61 are also heat sealed with the folded portions 4 and 60. In addition, the webs of panel material 1 and 2 are slit along the longitudinal centerline of panel material 1 and 2 by a slitter 68. The webs of panel material 1 and 2 are then cut widthwise thereof by a cutter 31 whenever being fed intermittently. The apparatus can therefore successively make plastic bags two by two.

Figure 19:
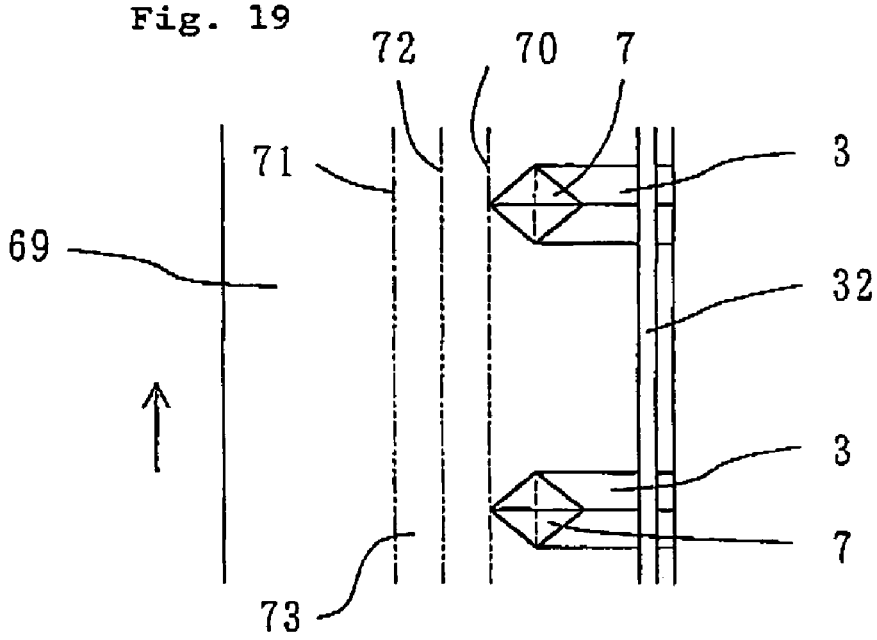
FIG. 19 is an explanatory view of other embodiment.

In other embodiment shown in FIG. 19, the web means of panel material comprises a web of panel material 69 which is wide. The web of panel material 69 comprises a plastic film. In addition, the web of panel material 69 is fed longitudinally thereof by panel material feeding means. The panel material feeding means comprises feeding rollers to which the web of panel material 69 is directed. The feeding rollers are rotated intermittently so that the web of panel material 69 can be fed intermittently with sheets of side gusset material 3 being supplied one by one, as in the case of the apparatus of FIG. 1. Each of the sheets of side gusset material 3 has a double width, which is previously folded into halves on the opposite sides of the longitudinal centerline to be superposed into two layers. The sheet of side gusset material 3 includes an end portion folded at an angle of 45°. The end portion is folded into halves and interposed between the layers of side gusset material 3 so that an auxiliary gusset portion 7 can be formed by the end portion, as also in the case of the apparatus of FIG. 1. The sheet of side gusset material 3 is then supplied to and put on the web of panel material 69 to extend widthwise thereof. In addition, the upper layer of side gusset material 3 is kept folded at the position of the end portion thereof so that the auxiliary gusset portion 7 can be kept opened. The web of panel material 69 and the sheet of side gusset material 3 are then heat sealed or ultrasonic sealed with and adhered to each other along the longitudinal centerline of the sheet of side gusset material 3 by heat seal or ultrasonic seal means.

Furthermore, in the apparatus, first and second folded lines 70 and 71 are assumed on the web of panel material 69 to extend longitudinally of the web of panel material 69. An intermediate folded back line 72 is assumed on the web of panel material 69 to extend longitudinally of the web of panel material 69 and between the first and second folded lines 70 and 71. The sheet of side gusset material 3 is supplied to and put on and heat sealed or ultrasonic sealed with the web of panel material 69 on one of the opposite sides of the first and second folded lines 70 and 71 and the intermediate folded back line 72. The sheet of side gusset material 3 extends widthwise of the web of panel material 69 to reach the first folded line 70.

The web of panel material 69 is then guided by panel material guide means to be folded and folded back along the first and second folded lines 70 and 71 and the intermediate folded back line 72 when being fed so that a folded portion 73 can be formed in the web of panel material 69 and between the first and second folded lines 70 and 71 and folded into halves. The web of panel material 69 is superposed into two layers between which the folded portion 73 is interposed, as described later in detail.

Figure 20:
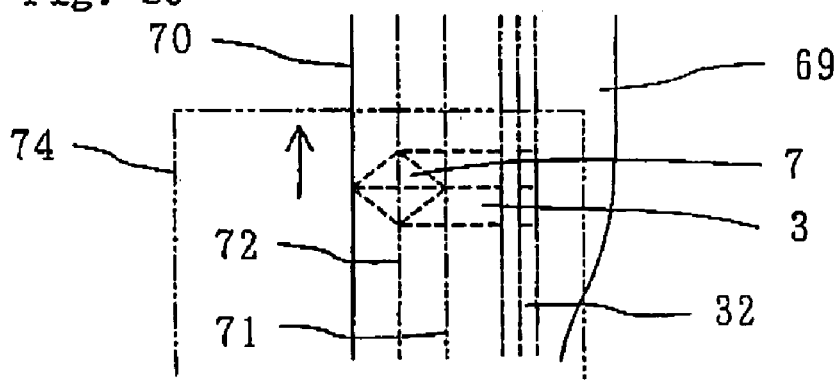
FIG. 20 is an explanatory view of the web of panel material of FIG. 19 when being folded along the first folded line.

The panel material guide means includes first guide means 74 by which the web of panel material 69 is guided to be folded along the first folded line 70 when being fed and after the sheet of side gusset material 3 is supplied so that the sheet of side gusset material 3 is covered with the folded portion of the web of panel material 69, as shown in FIG. 20. The folded portion is then heat sealed or ultrasonic sealed with the upper layer of auxiliary gusset portion 7 which is kept opened as described earlier, by heat seal or ultrasonic seal means.

Figure 21:
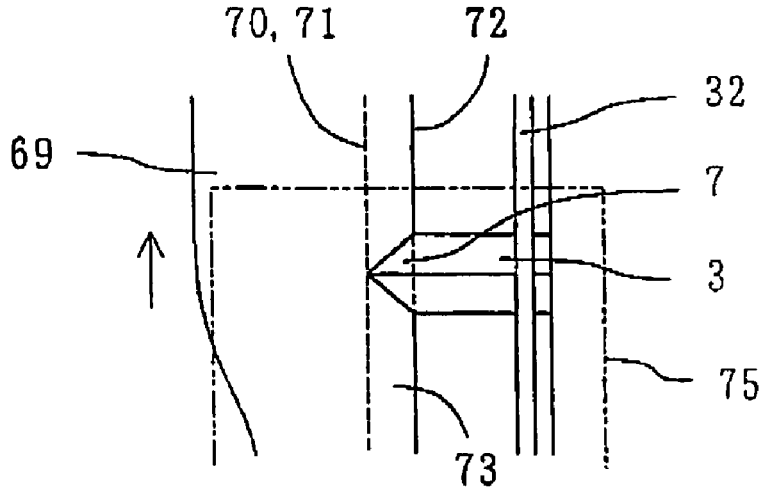
FIG. 21 is an explanatory view of the web of panel material of FIG. 20 when being folded back along the intermediate folded back line.

The panel material guide means further includes second guide means 75 by which the web of panel material 69 is guided to be folded back along the intermediate folded back line 72 when being fed and after being folded to make the upper layer of auxiliary gusset portion 7 pulled and closed, as shown in FIG. 21. The layers of auxiliary gusset portion 7 therefore stride the folded portion 73 of panel material 69.

Figure 22:
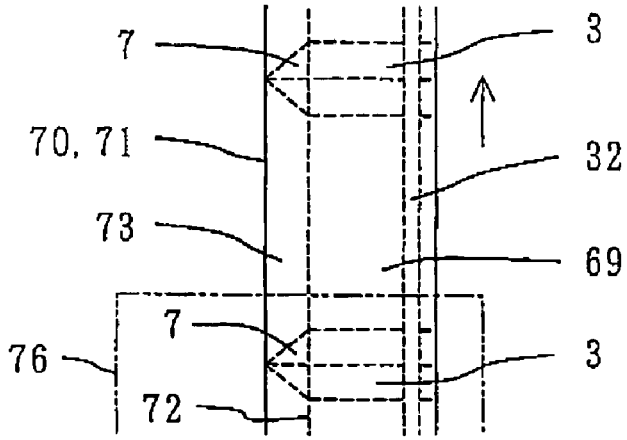
FIG. 22 is an explanatory view of the web of panel material of FIG. 21 when being folded along the second folded line.

The panel material guide means further includes third guide means 76 by which the web of panel material 69 is guided to be folded along the second folded line 71 when being fed and after being folded back, as shown in FIG. 22. The folded portion 73 is therefore formed in the web of panel material 69 and folded into halves. In addition, the web of panel material 69 is superposed into two layers between which the folded portion 73 and the sheet of side gusset material 3 are interposed.

The folded portion 73 is therefore combined with the sheet of side gusset material 3 by means of folded and folded back procedures in which the web of panel material 69 is folded, then folded back and folded back again by the first, second and third guide means 74, 75 and 76. The first and second guide means 74 and 75 have the same structures as those of FIG. 2. The third guide means 76 has also the same structure as the panel material guide means of FIG. 2.

Figure 23:
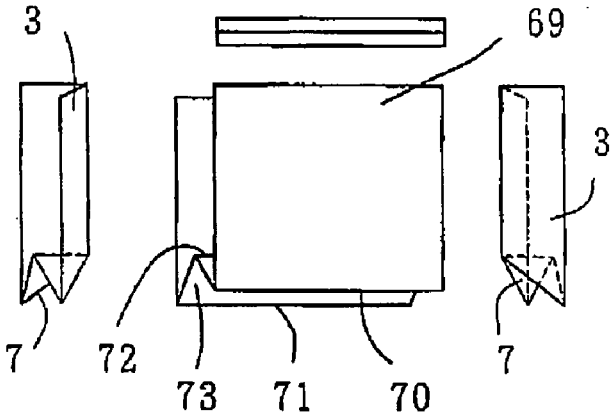
FIG. 23 is an explosive view of a plastic bag obtained by the apparatus of FIG. 19.

The web of panel material 69 is then heat sealed with the sheet of side gusset material 3 widthwise of the web of panel material 69 by cross seal means whenever being fed intermittently. The auxiliary gusset portion 7 and the folded portion 72 are also heat sealed with each other. The web of panel material 69 and the sheet of side gusset material 3 are then cut along the longitudinal centerline of side gusset material 3 whenever being fed intermittently, to successively make plastic bags of FIG. 23.

In the apparatus of FIG. 19, a fastener 32 can be interposed between the layers of panel material 69 to be incorporated into the plastic bag.

Figure 24:
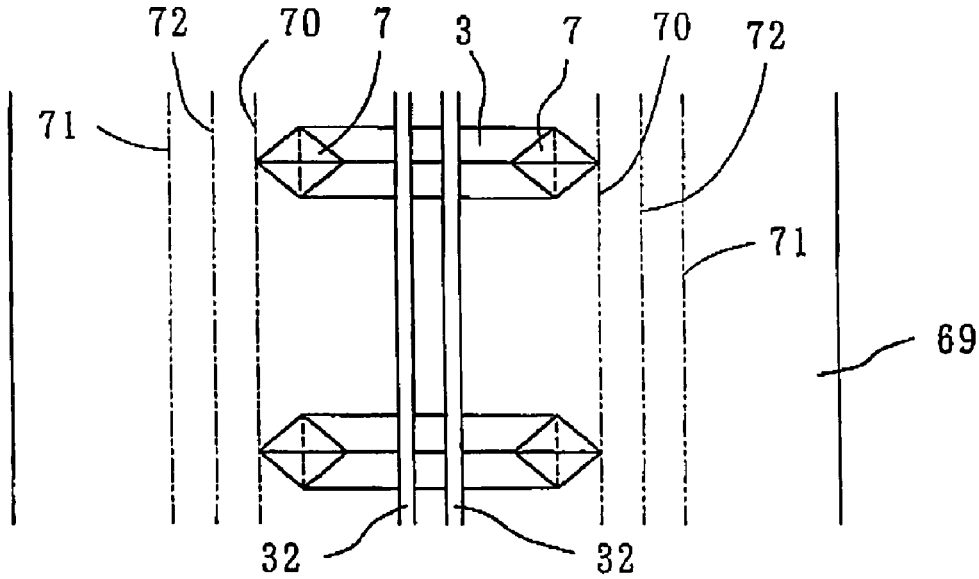
FIG. 24 is an explanatory view of other embodiment.

The apparatus can be arranged to successively make plastic bags two by two. In this case, auxiliary gusset portions 7 are formed by the opposite end portions of side gusset material 3 respectively, as shown in FIG. 24. The sheet of side gusset material 3 is then supplied to and heat sealed or ultrasonic sealed with the web of panel material 69. In addition, the first and second folded lines 70 and 71 are assumed on the web of panel material 69 on each of the opposite sides of the sheet of side gusset material 3. The intermediate folded back line 73 is assumed, to extend between the first and second folded lines 70 and 71.

The web of panel material 69 is then guided by the first guide means to be folded along the first folded line 70 on one of the opposite sides of the sheet of side gusset material 3 so that a folded portion can be formed in the web of panel material 69. The folded portion is then heat sealed or ultrasonic sealed with the upper layer of auxiliary gusset portion 7. The web of panel material 69 is then guided by the second guide means to be folded back along the intermediate folded back line 72 to make the upper layer of auxiliary gusset portion 7 pulled and closed. The layers of auxiliary gusset portion 7 therefore stride the folded portion of panel material 69. The web of panel material 69 is then guided by the third guide means to be folded along the second folded line 71. The folded portion is therefore formed between the first and second folded lines 70 and 71 and folded into halves. The web of panel material 69 is superposed into two layers between which the folded portion and the sheet of side gusset material 3 are interposed.

The web of panel material 69 is then folded along the first folded line 70 on the other side of the sheet of side gusset material 3 so that a folded portion can be formed in the web of panel material 69. The folded portion is then heat sealed or ultrasonic sealed with the upper layer of auxiliary gusset portion 7. The web of panel material 69 is then folded back along the intermediate folded back line 72 to make the upper layer of auxiliary gusset portion 7 closed. The layers of auxiliary gusset portion 7 therefore stride the folded portion of panel material 69. The web of panel material 69 is then folded along the second folded line 71. The folded portion is therefore formed between the first and second folded lines 70 and 71 and folded into halves. The web of panel material 69 is superposed into two layers between which the folded portion and the sheet of side gusset material 3 are interposed.

The web of panel material 69 may be folded along the first folded lines 70 on the opposite sides of the sheet of side gusset material 3 at a time so that folded portions can be formed in the web of panel material 69. In this case, the folded portions should be guided by additional guide means to be raised at the center portion of the web of panel material 69 so as not to interfere with each other. The web of panel material 69 may then be folded back and folded along the intermediate folded back line 72 and the second folded line 71 on the opposite sides of the sheet of side gusset material 3 at a time.

The web of panel material 69 is then heat sealed with the sheet of side gusset material 3 by cross seal means. The auxiliary gusset portion 7 and the folded portion are also heat sealed with each other. The web of panel material 69 is then slit longitudinally thereof by a slitter, as in the case of the apparatus of FIG. 14. The web of panel material 69 and the sheet of side gusset material 3 are then cut widthwlse thereof by a cutter, to successively make plastic bags two by two.

The panel material feeding means may comprise the feeding rollers 12 and 13 and some others disposed in positions so that the web means of panel material 1 and 2 can be fed longitudinally thereof by each of the feeding rollers in each of the embodiments.

The web means of panel material 1 and 2 may be fed not intermittently but continuously and guided by panel material guide means to be folded and folded back.

Figure 25:
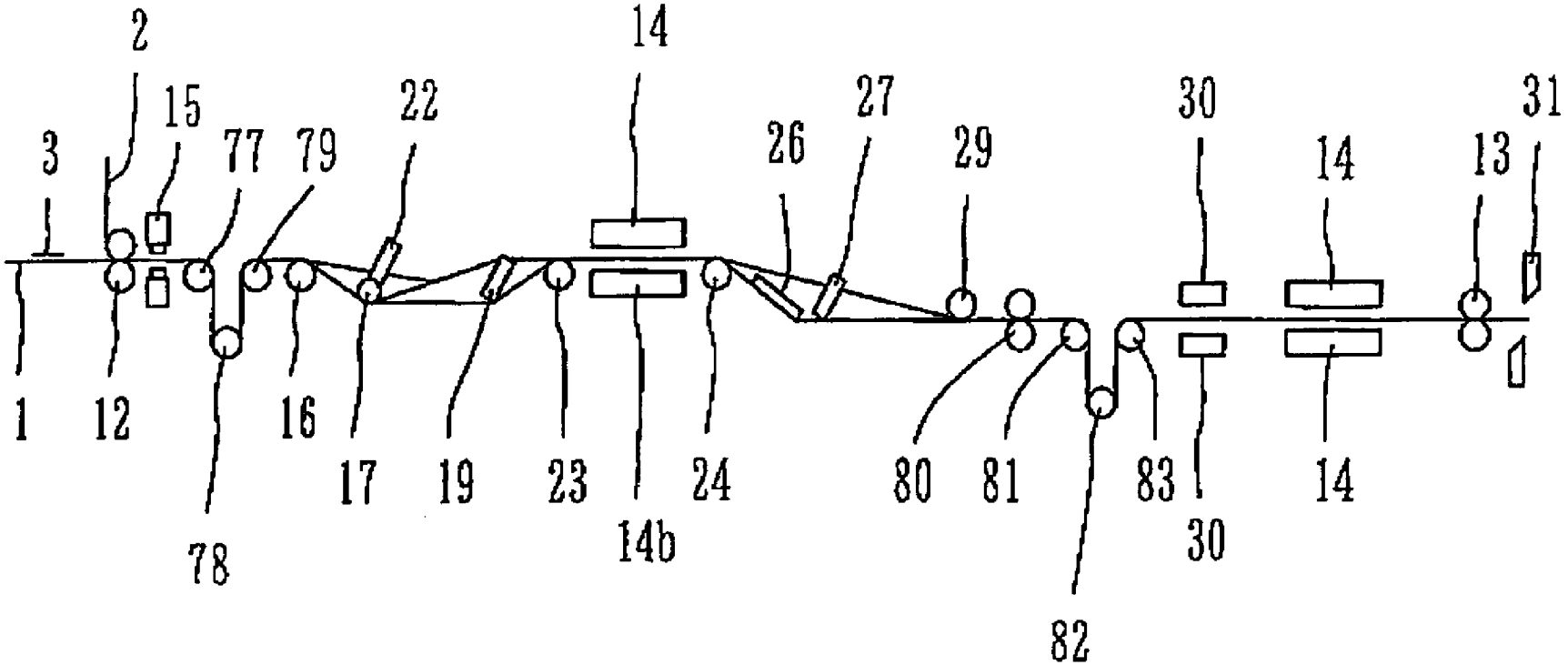
FIG. 25 is a side view of other embodiment.

For example, in other embodiment shown in FIG. 25, the web means of panel material comprises webs of panel-material 1 and 2 superposed into two layers. The layers of panel material 1 and 2 are directed to the feeding rollers 12, superposed with each other and fed intermittently by the feeding rollers 12. The layers of panel material 1 and 2 are then heat sealed or ultrasonic sealed with the sheet of side gusset material 3 by heat seal or ultrasonic seal means 15 and directed to a guide roller 77, an accumulator roller 78 and a guide roller 79 to be accumulated by the accumulator roller 78. The webs of panel material 1 and 2 are then directed to feeding rollers 80 through panel material guide means. The feeding rollers 80 are rotated continuously. The webs of panel material 1 and 2 are therefore fed continuously by the feeding rollers 80 and folded and folded back along the longitudinal folded line and the longitudinal folded back line by the panel material guide means.

In the embodiment of FIG. 25, the panel material guide means has the same structure as that of FIG. 2. The layers of panel material 1 and 2 are sandwiched between the longitudinal seal bar 14, the plate 14*a* and the receiver 14*b* so that the free side edge 11 and the corresponding side edge 9 can be heat sealed with each other by the seal bar 14, as also in the case of the apparatus of FIG. 2. In addition, the longitudinal seal bar 14, the plate 14*a* and the receiver 14*b* are moved in the direction in which the webs of panel material 1 and 2 are fed continuously, when the free side edge 11 and the corresponding side edge 9 are heat sealed with each other. Accordingly, the free side edge 11 and the corresponding side edge 9 can be heat sealed with each other in spite of the webs of panel material 1 and 2 fed continuously.

The webs of panel material 1 and 2 are then directed to a guide roller 81, an accumulator roller 82 and a guide roller 83 to be accumulated by the accumulator roller 82. The webs of panel material 1 and 2 are directed to the feeding rollers 13 through cross seal means 30 and longitudinal seal means 14, as in the case of the apparatus of FIG. 2. The webs of panel material 1 and 2 are therefore fed intermittently by the feeding rollers 13 and heat sealed respectively by the cross seal means 30 and the longitudinal seal means 14. The webs of panel material 1 and 2 are then cut widthwise thereof by the cutter 31, as also in the case of the apparatus of FIG. 2.

In other embodiments, accumulator rollers may be disposed in positions so that the webs of panel material 1 and 2 can be fed continuously and guided by panel material guide means to be folded and folded back.

Accordingly, the apparatus can make plastic-bags each of which includes a bottom gusset portion formed by the folded portion of panel material, according to the invention. As a result, no web of bottom gusset material is required to be supplied. The apparatus need therefore not to involve bottom gusset supply means, to be simple in structure and low in cost. Furthermore, the apparatus can make the panel portion and the bottom gusset portion printed by making the web means of panel material printed. In this case, no discrepancy is brought in print between the panel portion and the bottom gusset portion.

The invention claimed is:

1. An apparatus for successively making plastic bags each of which includes a bottom gusset portion incorporated into superposed two layers of panel portion, the apparatus comprising:

panel material feeding means by which web means of panel material is fed longitudinally thereof; and panel material guide means by which the web means of panel material is guided to be folded and folded back along a longitudinal folded line and a longitudinal folded back line when being fed so that a folded portion can be formed in the web means of panel material and folded into halves, the panel material guide means comprising:

first guide means by which the web means of panel material is guided to be folded along the longitudinal folded line into superposed two layers when being fed; and second guide means by which the web means of panel material is guided to be folded back along the longitudinal folded back line when being fed and after being folded into superposed two layers so that the folded portion can be formed in the web means of panel material and folded into halves, the plastic bag including the bottom gusset portion formed by the folded portion and incorporated into the layers of panel portion which are formed by the web means of panel material.

2. The apparatus as set forth in claim 1 further comprising:

side gusset material supply means by which sheets of side gusset material are supplied to the web means of panel material to extend widthwise thereof, the plastic bag further including side gusset portions formed by the sheets of side gusset material.

3. An apparatus for successively making plastic bags each of which includes a bottom gusset portion incorporated into superposed two layers of panel material, the apparatus comprising:

panel material feeding means by which web means of panel material is fed longitudinally thereof, the web means of panel material being superposed into two layers each of which has opposite side edges;

panel material guide means by which one of the layers of panel material is guided to be folded and folded back along a longitudinal folded line and a longitudinal folded back line near one of the side edges thereof when being fed so that a folded portion can be formed in said one of the layers of panel material and folded into halves, the folded portion having a free side edge formed by said one of the side edges, said folded portion being interposed between the layers of panel material; and longitudinal seal means by which the free side edge is heat sealed with the corresponding side edge of the other layer of panel material before or after the folded portion is folded into halves, the panel material guide means comprising:

first guide means by which said one of the layers of panel material is guided to be folded along the longitudinal folded line into superposed two layers when being fed; and second guide means by which said one of the layers of panel material is guided to be folded back along the longitudinal folded back line when being fed and after being folded into superposed two layers so that the folded portion can be formed in said one of the layers of panel material and folded into halves, the plastic bag including the bottom gusset portion formed by the folded portion and incorporated into the layers of panel portion which are formed by the web means of panel material.

4. The apparatus as set forth in claim 3 further comprising:

side gusset material supply means by which sheets of side gusset material are supplied to the web means of panel material to extend widthwise thereof, the sheets of side gusset material being interposed between the layers of panel material; and cross seal means by which the layers of panel material are heat sealed with the sheets of side gusset material, the plastic bag further including side gusset portions formed by the sheets of side gusset material.

5. The apparatus as set forth in claim 4 wherein said one of the layers of panel material is superposed with the other layer of panel material before being folded, to have said one of the side edges protruding beyond the corresponding side edge of the other layer of panel material at a distance, said one of the layers of panel material being then folded by the first guide means at a width which corresponds to the distance between said one of the side edges and the corresponding side edge while the other layer of panel material is folded by the first guide means at a width which is half as much as the distance so that said one of the side edges can be coincided with the corresponding side edge, said one of the layers of panel material being then folded back by the second guide means so that the folded portion can be formed in said one of the layers of panel portion and folded into halves while the other layer of panel material is unfolded for restoration so that the folded portion can be combined with the sheet of side gusset material and interposed between the layers of panel material.

6. The apparatus as set forth in claim 4 wherein said one of the layers of panel material is guided by the first guide means to be folded along the longitudinal folded line when being fed and after the sheet of side gusset material is supplied, said one of the layers of panel material being guided by the second guide means to be folded back along the longitudinal folded back line when being fed and after being folded so that the folded portion can be formed in said one of the layers of panel material and folded into halves, the folded portion being combined with the sheet of side gusset material by means of folded and folded back procedures in which said one of the layers of panel material is folded and then folded back by the first and second guide mans.

* * * * *